US009069317B2

(12) United States Patent
Furuyama

(10) Patent No.: US 9,069,317 B2
(45) Date of Patent: Jun. 30, 2015

(54) SURFACE TREATMENT APPARATUS HAVING REUSABLE FILM

(75) Inventor: Yoichi Furuyama, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 163 days.

(21) Appl. No.: 13/402,195

(22) Filed: Feb. 22, 2012

(65) Prior Publication Data

US 2012/0213565 A1 Aug. 23, 2012

(30) Foreign Application Priority Data

Feb. 23, 2011 (JP) ..... 2011-037717

(51) Int. Cl.

| | |
|---|---|
| ***G03G 15/20*** | (2006.01) |
| ***G03G 15/00*** | (2006.01) |
| ***B41J 2/32*** | (2006.01) |
| ***B41J 29/38*** | (2006.01) |

(52) U.S. Cl.

CPC .. *G03G 15/6585* (2013.01); *G03G 2215/00417* (2013.01); *G03G 15/6588* (2013.01); *G03G 15/6591* (2013.01); *G03G 2215/00421* (2013.01); *G03G 2215/00426* (2013.01); *G03G 2215/0081* (2013.01); *B41J 2/32* (2013.01); *B41J 29/38* (2013.01); *G03G 2215/00805* (2013.01); *G03G 2215/0129* (2013.01)

(58) Field of Classification Search

CPC ..... G03G 15/6585; G03G 15/6588; G03G 15/6591; G03G 2215/00417; G03G 2215/00421; G03G 2215/00426; G03G 2215/00805; G03G 2215/0081

USPC ..... 399/341, 342

See application file for complete search history.

(56) References Cited

U.S. PATENT DOCUMENTS

| | | | | |
|---|---|---|---|---|
| 4,954,845 | A * | 9/1990 | Yano et al. | 399/329 |
| 6,356,735 | B1 * | 3/2002 | Hozumi | 399/395 |
| 6,741,831 | B2 * | 5/2004 | Seto | 399/388 |
| 7,024,149 | B2 | 4/2006 | Kito et al. | |
| 7,783,242 | B2 | 8/2010 | Chigono et al. | |
| 8,078,080 | B2 | 12/2011 | Sawada et al. | |
| 2004/0096250 | A1 | 5/2004 | Kito et al. | |
| 2006/0285903 | A1 * | 12/2006 | Yamane et al. | 399/394 |

(Continued)

FOREIGN PATENT DOCUMENTS

| | | | |
|---|---|---|---|
| JP | 10-315515 | A | 12/1998 |
| JP | 10315515 | A * | 12/1998 |
| JP | 2004-170548 | A | 6/2004 |

(Continued)

*Primary Examiner* — David Gray
*Assistant Examiner* — Tyler Hardman
(74) *Attorney, Agent, or Firm* — Fitzpatrick, Cella, Harper & Scinto

(57) ABSTRACT

A glossing apparatus for glossing at least part of a toner image on a recording material includes a film, a supply roller on which the film is wound, a wind-up roller configured to wind-up the film, and a driving device configured to drive the wind-up roller to rotate. In addition, a heating device heats at least part of the toner image on the recording material through the film at a heating position between the supply roller and the wind-up roller in a heating operation, a reversing device reverses the film to the supply roller to use an unused area of the film not having been contacted to the recording material during the heating operation, and a conveying device conveys the recording material toward the heating position so that the toner image on the recording material is heated using the unused area of the film.

11 Claims, 9 Drawing Sheets

(56) References Cited

U.S. PATENT DOCUMENTS

2007/0147917 A1 6/2007 Chigono et al.
2012/0003346 A1* 1/2012 Chigono et al. ..... 425/363

FOREIGN PATENT DOCUMENTS

JP 2004170548 A * 6/2004
JP 2007-86747 A 4/2007

* cited by examiner

SURFACE TREATMENT APPARATUS HAVING REUSABLE FILM

FIELD OF THE INVENTION AND RELATED ART

The present invention relates to a surface treatment apparatus capable of providing a specific area or areas of the image bearing surface of a print (surface treatment recipient) with a desired appearance in terms of texture, color, etc.

In most prints, their recording mediums are different in gloss from their coloring agent. Thus, their surface gloss is affected by their print ratio. Thus, there have been proposed various methods for making a print uniform in gloss across the entirety of the image bearing surface of the print by giving the print a post-treatment, such as coating a specific area or areas of the image bearing surface of the print with a specific substance.

There have been also proposed recently various technologies for controlling a print in gloss. For example, in the field of offset printing, various expressions have become possible in terms of gloss with the use of the following methods. According to one of them, after an image is printed on a sheet of recording medium with the use of ink which contains coloring agent, a specific area or areas of the sheet are covered with UV-curable transparent ink by offset printing. Then, the entirety of the image bearing surface of the sheet is irradiated with UV-ray to fix the UV-curable transparent ink. This method makes it possible to increase in gloss a specific area or areas (photograph and/or title portions) of the print (sheet of recording medium), making it thereby possible to output a print which is rich in visual effects.

Further, in the field of electrophotography, various methods have been proposed to increase in gloss the entirety of the image bearing surface of a sheet of recording medium in order to output a photographic print (Japanese Laid-open Patent Application 2007-086747, for example). According to this patent application, an image was formed of toner on a sheet of recording medium, and then, the fixed toner image on the sheet was remelted by reheating the toner image through an endless belt which is very smooth in surface texture. Then, the toner is allowed to cool while remaining in contact with the belt so that the toner solidifies while remaining in contact with the smooth surface of the belt. This method can control in gloss the entirety of the image bearing surface of the sheet (print). However, it is difficult to control in gloss a specific area or areas of the sheet (print) with the use of this method.

There has been disclosed in Japanese Laid-open Patent Application 2004-170548 a method for controlling in gloss a specific area or areas of the image bearing surface of a print, with the use of a thermal head. This method heats a specific area or areas of the image bearing surface of a sheet of recording medium (print) with the use of a thermal head, and then, conveys the sheet (print) with the endless belt while keeping the sheet (print) pressed upon the endless belt with a pressure roller. Then, the sheet (print) is allowed to cool while being kept in contact with the endless belt. Consequently, the superficial texture of the endless belt is transferred onto the specific area or areas of the image bearing surface of the sheet of recording medium (print), which was heated with the thermal head.

There has also been disclosed in Japanese Laid-open Patent Application H10-315515 a method for making glossy the entirety of the image bearing surface of a print (sheet of recording medium) with the use of a thermal transfer printer. This method uses a piece of ink film made up of an area having an ink layer area, that is, an area having ink layer, and a resin layer area, that is, an area having no ink layer. First, the ink layer of the ink film is transferred onto a print (sheet of recording medium). Then, the ink-free area of the ink film is sent into the area between the thermal head and platen roller, and a thermal head is pressed against a platen roller with the presence of the ink film, and the print (sheet of recording medium) having the transferred ink layer, between the thermal head and platen roller, to reheat the ink layer on the sheet in order to make flat and smooth the surface of the ink layer on the sheet.

After earnest studies of these patent applications, the inventors of the present invention discovered that the method for heating a specific area or areas of the image bearing surface of a print with the use of a combination of a thermal head and a thin sheet of film is suitable for controlling gloss in the specific area or areas of the image bearing surface of a print which has an electrophotographically formed image. This method makes it possible to heat any point of the image bearing surface of a print by electrically controlling the thermal head. In a case where an object to be treated is a print, that is, a combination of a sheet of recording medium and an image electrophotographically formed of toner on the sheet, the optional point (any point) of the image bearing surface of the print (sheet of recording medium) can be controlled in gloss by melting the toner image on the sheet of recording medium by heating the toner image through the film, allowing it to cool, and then, separating it from the film.

A thermal head is small in the amount of heat it can provide. Thus, in order to sufficiently heat a toner image on a sheet of recording medium, the film through which the toner image is heated by the thermal head is desired to be very thin, which creates a problem. That is, as very thin film is heated, it deforms; it shrinks. Thus, it is unlikely to be repeatedly usable. In other words, once it is used, it has to be discarded. Thus, one of the simple and convenient ways to use very thin film as the medium through which a toner image on a sheet of recording medium is heated by a thermal head is to roll thin film around a supply roller (shaft), take it up by a take-up roller as it is used, and then, discard it.

However, in order for a post treatment apparatus to be able to meet various needs of a user, it is structured so that it can treat not only a small sheet of recording medium such as a post-card and an ordinary mail envelop, but also, a large sheet of recording medium such as a sheet of paper of a size A3. Therefore, the film to be used by a post treatment apparatus is desired to be wide enough to treat the largest sheet of recording medium which the apparatus can treat. However, once a given area of a thin sheet (roller) of thin film in terms of the film conveyance direction is used to treat an object to be treated, this area of the thin sheet of film wrinkles as described above, making it impossible for this area of the thin film to be used again. In a case where a small object (sheet of recording medium) is to be treated, the sheet of thin film is used only across its area which corresponds in position to the object to be treated. That is, the film is not used entirely in terms of its widthwise direction. In other words, a large unused area of the film is discarded, making the post treatment apparatus very wasteful in terms of film usage.

SUMMARY OF THE INVENTION

According to an aspect of the present invention, there is provided a surface treatment apparatus comprising a film capable of being unwound out of a supply shaft and taken up on a winding-up shaft; a heating device for heating a surface of an object through said film; a film driving device for driving said film such that said film is unwound out of said supply shaft and wound up on said winding-up shaft and such that said film is unwound out of said winding-up shaft and is wound up on said supply shaft; a moving device for moving said film widthwisely before the object is contacted to said film; and a controller for controlling, when the objects having a width smaller than one half of a width of said film are heated continuously, said film driving device and said moving device to effect the winding up of said film on said supply shaft and to effect movement of said film widthwisely by said moving device so that the objects are contacted to lengthwisely the same and widthwisely different areas of said film, while heating the objects.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the surface treatment apparatuses in the preferred embodiments of the present invention are described in detail with reference to the appended drawings.

Embodiment 1

1. System Structure

Figure 1:
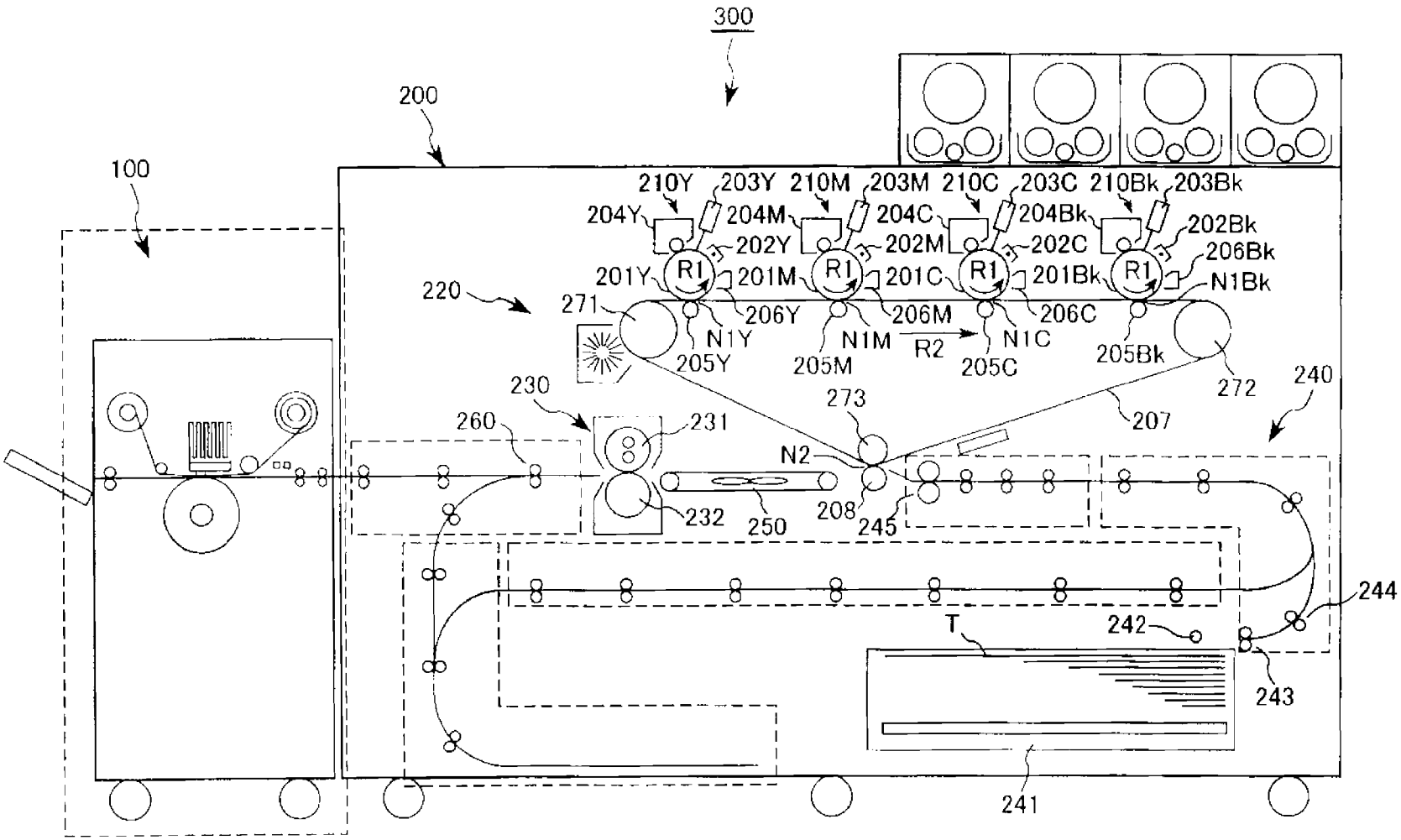
FIG. 1 is a schematic sectional view of the image formation system equipped with a surface treatment apparatus in the first embodiment of the present invention.

FIG. 1 is a schematic sectional view of the image formation system equipped with the surface treatment apparatus in the first embodiment of the present invention. It shows the general structure of the system. In this embodiment, the surface treatment apparatus 100 is in connection to an electrophotographic image forming apparatus 200, making up an image formation system 300. The image formation system 300 electrophotographically forms an image of thermally meltable toner, on a sheet T of recording medium such as a sheet of recording paper, and then, delivers the sheet T (print) to the surface treatment apparatus 100, which is in connection to the downstream side of the image forming apparatus 100 in terms of the sheet conveyance direction. Then, the surface treatment apparatus 100 subjects the sheet T (print as object to be treated) having the electrophotographically formed toner image to a treatment (surface treatment) for controlling the image bearing surface of the sheet T (print) in surface texture, and outputs the sheet T (print).

2. Image Forming Apparatus

The image forming apparatus 200 is a digital printer of the so-called tandem type, which is capable of forming a full-color image with the use of an electrophotographic image formation method. It employs an intermediary transferring means. The operation to form an image of toner, on the sheet T of recording medium is carried out primarily by a printer section 220, which has multiple image formation stations, more specifically, the first, second, third, and fourth image formations 210Y, 210M, 210C, and 210Bk which form yellow (Y), magenta (M), cyan (C) and black (Bk) monochromatic images, respectively.

The image formation stations 210Y, 210M, 210C and 210Bk are practically the same in structure and operation, although they are different in the color of the toner they use. Therefore, in the following description of the embodiments of the present invention, suffixes Y, M, C and Bk of the referential codes to indicate the color of the monochromatic toner image they form, are not going to be shown in order to describe the image formation stations 210 together.

The image formation station 210 is provided with a photosensitive drum 201, which is an electrophotographic photosensitive member (photosensitive member) as an image bearing member. The photosensitive drum 201 is rotated in the direction indicated by an arrow mark R1 in FIG. 1. The image formation station 210 is also provided with a charging device 202 (as charging means), an exposing device 203 (as exposing means: LED unit), a developing device 204 (as developing means), a primary transfer roller 205 (as primary transferring means), and a cleaning device 206 (as cleaning means), which are positioned in the listed order, in terms of the rotational direction of photosensitive drum 201, in the adjacencies of the peripheral surface of the photosensitive drum 201.

The image forming apparatus 200 is also provided with an intermediary transfer belt 207 (as intermediary transferring member), which is in the form of an endless belt. The intermediary transfer belt 207 is positioned so that it opposes the photosensitive drum 201 of each image formation station 210. More specifically, the intermediary transfer belt 207 is supported and tensioned by multiple belt supporting members, that is, a belt driving roller 271, a tension roller 272, a roller 273 (which opposes secondary transfer roller with presence of intermediary transfer belt 207 between itself and secondary transfer roller). As the belt driving roller 271 is rotated, the intermediary transfer belt 207 circularly moves in the direction indicted by an arrow mark R2 in FIG. 1. Each primary transfer roller 205 is on the inward side of the loop which the intermediary transfer belt 207 forms. It opposes the photosensitive drum 201 with the presence of the intermediary transfer belt 207 between itself and photosensitive drum 201. More specifically, the primary transfer roller 205 is kept pressed against the peripheral surface of the photosensitive drum 201 with the presence of the intermediary transfer belt 207 between itself and a peripheral surface of the photosensitive drum 201, forming thereby the primary transfer station N1 (primary transfer nip), in which the intermediary transfer belt 207 is in contact with the peripheral surface of the photosensitive drum 201. Further, the image forming apparatus 200 is provided with the secondary transfer roller 208, which is on the outward side of the loop of the intermediary transfer belt 207 and opposes the aforementioned roller 273 with the presence of the intermediary transfer belt 207 between itself and the roller 203. More specifically, the secondary transfer roller 208 is kept pressed against the roller 237 with the presence of the intermediary transfer belt 207 between itself and roller 273, forming the secondary transfer station N2 (secondary transfer nip), in which the intermediary transfer belt 207 is in contact with the secondary transfer roller 208.

The image forming apparatus 200 is also provided with a fixing device 230 (as fixing means), which is on the downstream side of the secondary transfer station N2 in terms of the direction in which the sheet T of recording medium is conveyed.

Further, the image forming apparatus 200 has a recording medium feeding station 240, a pre-fixation recording medium conveyance station 250, and a recording medium discharge station 260. In terms of the direction in which the sheet T of recording medium is conveyed, the recording medium feeding station 240 is on the upstream side of the secondary transfer station N2, and the pre-fixation recording medium conveyance station 250 is between the secondary transfer station N2 and fixing device 230. The recording medium discharge station 260 is on the downstream side of the fixing device 230.

Next, the image forming operation of the image forming apparatus 200 is described with reference to the formation of a full-color image. As an image forming operation for forming a full-color image is started, the photosensitive drum 201 in each image formation station 210 is rotated in the aforementioned direction, and its peripheral surface is uniformly charged by the charging device 202. To the exposing device 203 of each image formation station 210, image formation signals obtained by separating an original (image to be formed) into monochromatic images are inputted. Then, the uniformly charged peripheral surface of the photosensitive drum 201 is scanned (exposed) to the beam of light emitted by the exposing device 203 while being modulated with the image formation signals. As a given point of the uniformly charged area of the peripheral surface of the photosensitive drum 201 is exposed to the beam of light from the exposing device 203, the electrical charge which the given point has is neutralized. Consequently, an electrostatic latent image (electrostatic image), which reflects the image formation signals, is effected on the peripheral surface of the photosensitive drum 201. Then, the electrostatic latent image on the peripheral surface of the photosensitive drum 201 is supplied with color toner by the developing device 204. As a result, the electrostatic latent image is developed into a visible image, that is, an image formed of the color toner. Then, the toner image on the peripheral surface of the photosensitive drum 201 is transferred (primary transfer) onto the intermediary transfer belt 207 by the function of the primary transfer roller 205. When the image forming apparatus 200 is in the full-color image formation mode, a toner image is formed on the peripheral surface of the photosensitive drum 201 of each image formation station 210. That is, four monochromatic toner images, different in color, are formed in the four image formations stations 210, one for one. Then the four monochromatic toner images, different in color, are sequentially transferred in layers (primary transfer) onto the intermediary transfer belt 207. That is, the four monochromatic toner images, different in color, are layered on the intermediary transfer belt 207 in such a manner that they effect a full-color image.

Meanwhile, in the recording medium feeding section 240, the sheets T of recording medium stored in a cassette 241 are fed into the main assembly of the image forming apparatus 200 by a feed roller 242 one by one while being separated from the rest by a pair of separation rollers 243. Then, each sheet T of recording medium is conveyed to a pair of registration rollers 245 by multiple pairs of recording medium conveyance rollers 244. If any of the sheets T becomes askew while it is fed into the main assembly and/or is conveyed to the pair of registration rollers 245, it is corrected in attitude as its leading edge is made to collide into the pair of registration rollers 245 by the conveyance.

The toner images on the intermediary transfer belt 207 are transferred onto the sheet T of recording medium by the function of the secondary transfer roller 208. Thereafter, the sheet T is conveyed to the fixing device 230 by the pre-fixation recording medium conveyance section 250. The fixing device 230 is made up of a pair of opposing rollers, a belt, etc., which form a fixation nip (area of contact between two rollers). As the sheet T is conveyed through the fixation nip, the fixing device 230 applies a preset amount of pressure and a preset amount of heat to the sheet T and the toner images thereon, whereby the toner images on the sheet T are melted, and become fixed to the sheet T as they cool down. Thus, the fixing device 230 is provided with a heater (as a heat source), which is controlled so that its temperature remains at the optimal level for fixation. In this embodiment, the fixing device 230 has a heat roller 231 and pressure roller 232. The heat roller 231 internally holds a heat source. The pressure roller 232 is kept pressed upon the heat roller 231, forming thereby the fixation nip between itself and the heat roller 231.

After the fixation of the toner images to the sheet T of recording medium by the fixing device 230, the sheet T is discharged from the image forming apparatus 200 by the recording medium discharge section 260. Then, it is conveyed to the surface treatment apparatus 100 which is in connection to the downstream end of the image forming apparatus 200 in terms of the recording medium conveyance direction. In this embodiment, the print, that is, the combination of the sheet T of recording medium, and the toner images which have just been fixed to the sheet T, is the recipient S of the surface treatment by the surface treatment apparatus 100.

Each of the color toners is in the form of microscopic particles, the primary ingredients of which are resin and pigment. In this embodiment, its primary ingredients are polyester resin and pigment.

3. General Structure of Surface Treatment Apparatus

Figure 2:
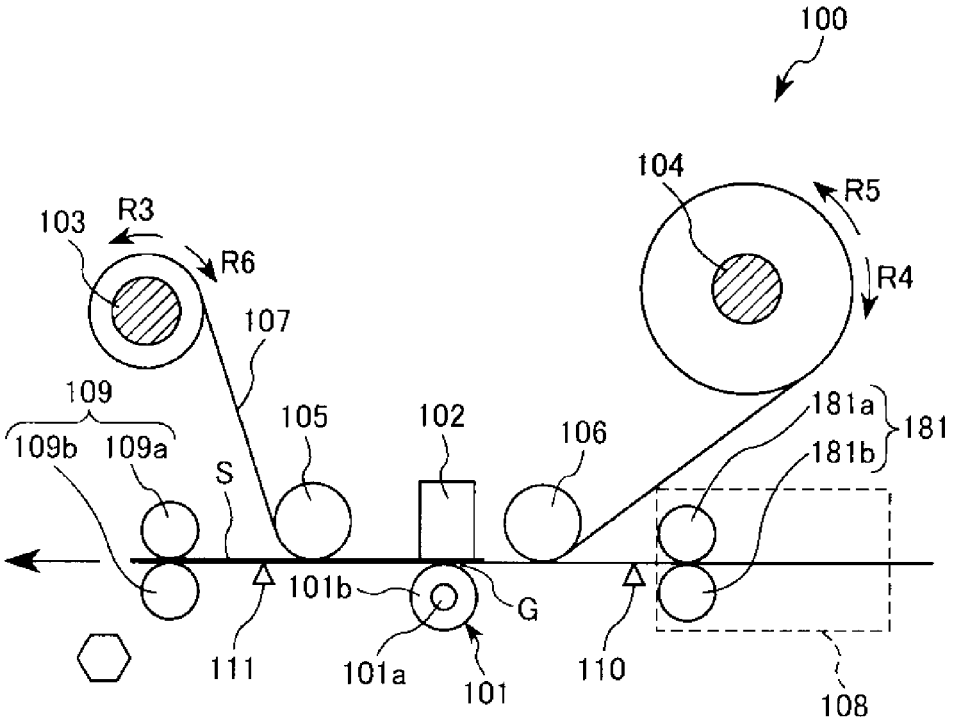
FIG. 2 is a schematic sectional view of the surface treatment apparatus in the first embodiment of the present invention.

FIG. 2 is a schematic sectional view of the essential portion of the surface treatment apparatus 100 in this embodiment. The surface treatment apparatus 100 has a platen roller 101 and a thermal head 102. The platen roller 101 is a supporting member in the form of a roller, and is positioned so that it opposes the thermal head 102 with the presence of the passage for the surface treatment recipient S (print), between itself and thermal head 102. The thermal head 102 is a heating means of the contact type. It is capable of heating a part, parts, or the entirety of the area it contacts. Not only does the platen roller 101 support the surface treatment recipient S, from underneath, but also, conveys the recipient S while the thermal head is pressed upon the recipient S, with the presence of a sheet 107 of film (which is described later). The thermal head 102 has a large number of heating elements which can be selectively activated according to the information about the areas of the surface treatment recipient S, which will be described later.

The surface treatment apparatus 100 has also the sheet of film 107 (which hereafter will be referred to simply as film 107), a take-up shaft 103, and a supply shaft 104. The film 107 is heated by the thermal head 102 in such a manner that as it is pressed by the thermal head 102 upon the surface treatment recipient S, its specific area or areas are selectively heated by the thermal head 102. The take-up shaft 103 is the shaft which takes up the film 107 as the film 107 is used. The supply shaft 104 is the shaft which holds a supply roll of the film 107. The take-up shaft 103 is rotated by a motor 141 (FIG. 7) as a take-up shaft driving power source. The supply shaft 104 is rotated by a motor 142 (FIG. 7) as a supply shaft driving power source. The take-up shaft driving motor 141 can rotate the take-up shaft 103 in the direction to take up the film 107 from the supply shaft 104 (direction indicated by arrow mark R3 in FIG. 2). That is, the surface treatment apparatus 100 is structured so that as the take-up roller 103 is rotated in the direction to take up the film 107, the supply roller shaft 104 is allowed to rotate in the direction to release the film 107 toward the take-up shaft 103 (direction indicated by arrow mark R4 in FIG. 2), and also, so that the supply roll shaft driving motor 142 can be rotated so that the supply shaft 104 in the direction to roll the film 107 back onto the supply shaft 104 from the take-up shaft 103 (direction indicated by arrow mark R5 in FIG. 2). Further, the surface treatment apparatus 100 is structured so that as the supply shaft 104 is rotated in the direction to take back the film 107 from the take-up roller, the take-up shaft 103 is allowed to rotate in the direction to return the film 107 to the supply shaft 104 (direction indicated by arrow mark R6 in FIG. 2).

Hereafter, the surface of the film 107, which contacts the surface treatment recipient S, may be referred to simply as "front surface", whereas the surface of the film 107, which is opposite from the "front surface" may be referred to as "back surface". Further, the surface of the surface treatment recipient S, which the film 107 contacts may be referred to as the "treatment surface" of the surface treatment recipient S, whereas the surface of the surface treatment recipient S, which is opposite from the "treatment surface" of the surface treatment recipient S, that is, the surface of the surface treatment recipient S, which contacts the platen roller 101, may be referred to as the "back surface" of the surface treatment recipient S.

The surface treatment apparatus 100 has also a separation roller 105 and a tension roller 106, which are positioned so that they contact the back surface of the film 107. The take-up shaft 103, film supply shaft 104, platen roller 101, separation roller 105, and tension roller 106, are roughly parallel to each other in terms of their rotational axis. The film 107 is rolled out from the roll of the film 107 on the film supply roller 104, is extended in such a manner that it wraps around a part of the peripheral surface of the tension roller 106, and is put through the pressure application section G (treatment section), which is between the thermal head 102 and platen roller 101. Further, the film 107 is attached to the take-up shaft 103, making it possible for the film 107 to be taken up by the take-up shaft 103. Here, the direction in which the film 107 is moved as the take-up shaft takes up the film 107 is going to be referred to as the "forward" direction, which is roughly perpendicular to the axial line of each of the aforementioned take-up shaft 103, film supply shaft 104, platen roller 101, separation roller 105, and tension roller 106. The direction in which the film 107 is conveyed through the treatment section G during the surface treatment of the surface treatment recipient S, and the direction in which the surface treatment recipient S is conveyed through the treatment section G during the surface treatment of the surface treatment recipient S are the same. The separation roller 105 separates the film 107 from the surface treatment recipient S after the film 107 is pressed upon the surface treatment recipient S by the thermal head 102 while being heated by the thermal head 102. The tension roller 106 adjusts the film 107 in tension. The tension roller 106 and separation roller 105 are rotated by the movement of the film 107.

Further, the surface treatment apparatus 100 has a registration unit 108 for correcting in attitude the surface treatment recipient S before the surface treatment recipient S is treated. The registration unit 108 is on the upstream side of the treatment section G in terms of the treatment subject conveyance direction. The registration unit 108 has a pair of pre-treatment registration rollers 181 (181*a* and 181*b*), which are kept pressed upon each other). The pair of registration rollers 181 are rotated by a registration roller driving motor 144 (FIG. 7) as a registration roller driving power source. The registration unit 108 corrects in attitude the surface treatment recipient S with its pair of registration rollers 181, and then, conveys the surface treatment recipient S to its treatment section G. More specifically, as the leading edge of the surface treatment recipient S, in terms of the surface treatment recipient conveyance direction, comes into contact with the pair of registration rollers 181, which are kept stationary, the surface treatment recipient S is corrected in attitude. The surface treatment apparatus 100 is structured so that the pair of registration rollers 181 are movable in the direction which is roughly perpendicular to the surface treatment recipient conveyance direction, by a registration roller moving means which is made up of a registration roller shaft motor (FIG. 7) (as a registration roller moving means), etc.

Further, the surface treatment apparatus 100 has a pair of surface treatment recipient conveyance rollers 109 (109*a* and 109*b*) for conveying the surface treatment recipient S after the surface treatment. The pair of surface treatment recipient conveyance rollers 109 are on the downstream side of the surface treatment station G in terms of the surface treatment recipient conveyance direction, and are kept pressed upon each other. The pair of surface treatment recipient conveyance rollers 109 convey the surface treatment recipient S into the external delivery tray of the surface treatment apparatus 100 after the surface treatment of the surface treatment recipient S.

The surface treatment apparatus 100 has also first and second sensors 110 and 111, respectively. In terms of the surface treatment recipient conveyance direction, the first sensor 110 is on the downstream side of the tension 206 and on the upstream side of the pair of registration roller pairs 181. It detects the presence or absence of the surface treatment recipient S. Also in terms of the surface treatment recipient conveyance direction, the second sensor 110 is on the downstream side of the separation roller 105 and on the upstream side of the pair of surface treatment recipient conveyance roller 109. It also detects the presence or absence of the surface treatment recipient S. The first and second sensors 110 and 111 make it possible to detect the location of the surface treatment recipient S while the surface treatment recipient S is being conveyed.

4. Structure of Each of Essential Sections of Surface Treatment Apparatus

Next, the structure of each of the essential sections of the surface treatment apparatus 100 is described.

4-1. Thermal Head

Figure 3:
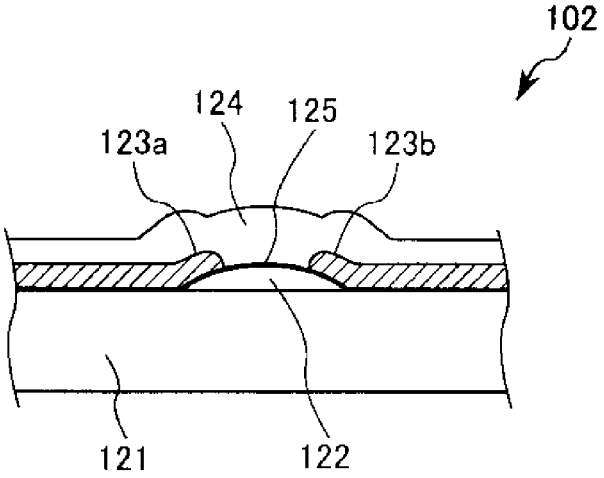
FIG. 3 is a schematic sectional view of an example of a thermal head, and shows the general structure of the head.

First, the thermal head 102 is described about its basic structure and specifications. FIG. 3 is a schematic sectional view of one of the heat generation elements of the thermal head 102. It shows the general structure of the element. Each of the heating elements of the thermal head 102 is made up of a substrate 121, a glaze 122 (thermal insulation layer), a common electrode 123*a*, a lead (individual) electrode 123*b*, and a heat generating resistor 125. The glaze 122 is formed on the substrate 121 by printing. The common and individual (lead) electrodes 123*a* and 123*b* are formed on the substrate 121, in contact with the glaze 122. The heat generating resistor 125 is formed on the glaze 122, in contact with both electrodes 123*a* and 123*b*. The thermal head 102 is also provided with a protective film 124 (overcoat layer), which covers the substrate 121, thermal insulation layer 122, electrodes 123*a* and 123*b*, and heat generating resistor 125. The thermal head 102 is in connection to a thermal head driving circuit 130 (FIG. 7) for selectively providing various heat generating elements of the thermal head 102 with electrical power to make them generate heat. Further, the thermal head 102 is provided with heat radiation plates, or the like, for releasing excessive amount of heat after giving heat to the surface treatment recipient S. The thermal head 102 has multiple heat generating elements (heating sections), which are in alignment in the direction which is roughly perpendicular to the surface treatment recipient conveyance direction. The multiple heat generating elements can be selectively activated so that the specific area or areas of the surface of the surface treatment recipient S can be heated by the thermal head 102 through the film 107.

The thermal head 102 used in this embodiment is 300 dpi in heat generating element density, 300 dpi in recording density (treatment density), 30 V in driving voltage, and 500Ω in average heat generating element resistance value. However, this embodiment is not intended to limit the present invention in terms of the structure and specification of the thermal head 102.

Figure 4:
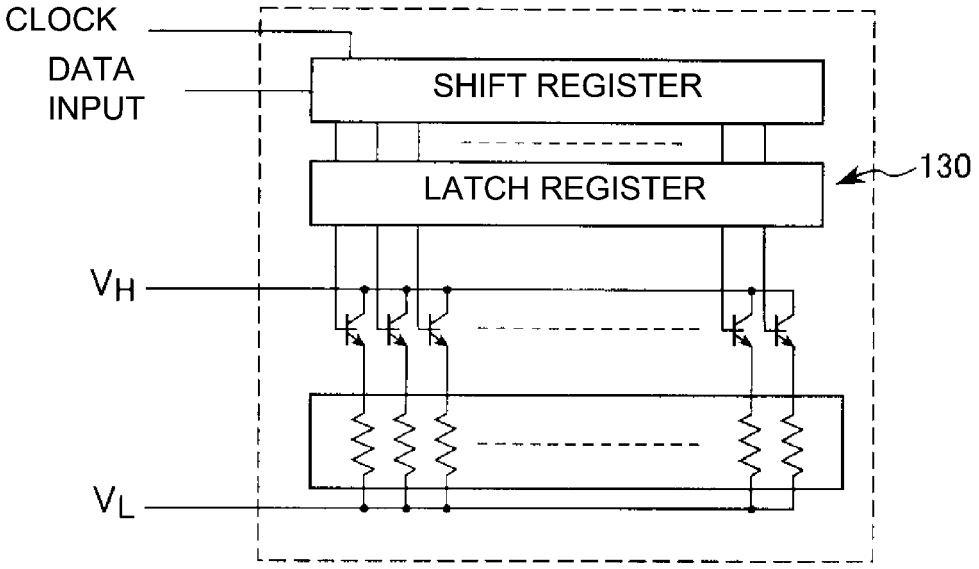
FIG. 4 is a diagram of an example of a thermal head driving circuit.

FIG. 4 is a general diagram of a typical circuit for driving thermal head 102. The thermal head driving circuit has an aluminum substrate, a single line of heat generating resistors, and a pair of electrodes. The single line of heat generating resistors is on the aluminum substrate. One of the pair of electrodes is on one side of the line of heat generating resistors, and the other is on the other side of the line of heat generating resistors. Further, the thermal head 102 is provided with a driver IC, which includes a group of registers for transferring and holding the data for the single line of heat generating resistors. The driver IC is on the aluminum substrate of the thermal head driving circuit, or on a wiring substrate which is different from the aluminum substrate of the thermal head driving circuit.

4-2. Platen Roller

The platen roller 101 is an elastic roller, which is made up of a shaft 101*a* (metallic core) and an elastic layer 101*b*. The elastic layer 101*b* is formed of a substance such as hard rubber which is high in coefficient of friction. It is in the form of a roller, and fits around the shaft 101*a*. More specifically, the platen roller 101 in this embodiment is a heat resistant rubber roller made by forming the elastic layer 101*b* of silicone rubber, on the peripheral surface of the shaft 101*a*, in the form of a roller which covers virtually the entirety of the peripheral surface of the shaft 101*a*. The platen roller 101 is rotatably attached by its shaft 101*a* to the main frame of the surface treatment apparatus 100. It is rotated by a platen roller driving motor 143 (FIG. 7) (as platen roller driving power source) by way of the shaft 101*a*. As the platen roller 101 is rotated, the surface treatment recipient S and film 107 are conveyed. In this embodiment, the speed at which the surface treatment recipient S is to be conveyed is determined by the rotational speed of the platen roller 101, and the data (treatment area information) which is to be sent to the thermal head 102 are determined based on the rotational speed of the platen roller 101. In this embodiment, the speed at which the surface treatment recipient S is conveyed through the surface treatment station G during the surface treatment of the surface treatment recipient S is roughly the same as the speed at which the film 107 is conveyed through the surface treatment station G during the surface treatment of the surface treatment recipient S. Further, the direction in which the surface treatment recipient S is conveyed through the surface treatment station G during the surface treatment of the surface treatment recipient S is the same as the direction in which the film 107 is conveyed through the surface treatment station G during the surface treatment of the surface treatment recipient S.

4-3. Film

The film 107 (transfer film) is provided in the form of a roll wound around the supply shaft 104 by a preset length. It is supplied to the surface treatment station G by being taken up, as necessary, by the take-up shaft 103. The film 107 is for heating a specific area or areas of the surface of the surface treatment recipient S. Therefore, it is desired to be made of thin and flexible material. From the standpoint of the thinness and flexibility required of the film 107, the film 107 is desired to be no more than 40 μm in thickness. From the standpoint of changing in gloss the surface of the surface treatment recipient S, the thickness of the film 107 can be as thin as 2 μm. However, it is desired to be no less than 4 μm from the standpoint of strength. Further, in order to enable the film 107 to give the surface of the surface treatment recipient S such a surface texture as that of a photograph, the film 107 is desired to have a certain amount of rigidity. Thus, in a case where one of the following substances is used as the material for the film 107, the film 107 is desired to be no less than 8 μm in thickness. Regarding the properties of the material for the film 107, the film 107 has to be capable of withstanding the heat from the thermal head 102. Thus, a substance such as polyimide, the heat resistance of which exceeds 200° C., is desired as the material for the film 107. However, ordinary resin film such as PET (polyethylene terephthalate) film, which is relatively inexpensive, may be used, although it suffers from thermal hysteresis. The front surface (which comes into contact with surface treatment recipient S) may be coated with a parting layer. This functional layer is low in surface energy, and is placed to make it easier for the film 107 to separate from the resin, of which the surface layer of the surface treatment recipient S is made. From the standpoint of how accurately transfer the surface texture of the film 107 onto the surface of the surface treatment recipient S, it is desired that the film 107 smoothly separates from the surface of the surface treatment recipient S. As the material for the parting layer for the film 107, fluorinated resin and silicone resin, for example, can be used. As for the method for forming the parting layer, the material for the parting layer may be coated on the substrate of the film 107. However, the method for applying the material for the parting layer to the substrate layer (base film) of the film 107 does not need to be limited to coating. What counts here is that the material for the parting layer can give the film 107 the surface texture which is to be transferred onto the surface of the surface treatment recipient S. For example, if it is necessary to provide the film 107 with a flat and smooth surface like the surface of an ordinary photograph, the base film (substrate) of the film 107 can be made flat and smooth by coating of one of the abovementioned substances. Further, the backside (which faces toward thermal head 102) of the base film of the film 107 may be covered with a stick prevention layer, in order to reduce the amount of mechanical friction between the thermal head 102 and film 107. The stick prevention layer on the backside of the film 107 is required to have characteristics similar to the abovementioned parting layer. Therefore, it is effective to coat the backside of the base film of the film 107 with fluorinated resin, silicone resin, or the like, which is similar to those used as the material for the parting layer of the film 107. The film 107 in this embodiment is made up of PET film (substrate), and a parting layer formed on PET film by coating.

The film 107 is for transferring its surface texture (and/or surface pattern) onto the surface of the surface treatment recipient S. Thus, if a piece of highly glossy and flat film is used as the film 107, the surface of the surface treatment recipient S can be made highly glossy like the surface of an ordinary photograph. On the other hand, if a piece of matte film formed by sandblasting or the like method, or a piece of film having a specific superficial texture (an/or pattern), is used as the film 107, the surface texture (and/or specific pattern) of the film 107 can be transferred in reverse onto the surface of the surface treatment recipient S. For example, various texture (and/or pattern) such as those of silk fabric, Japanese paper, embossed paper, etc., which are different in appearance, can be transferred onto the surface of the surface treatment recipient S. Further, by forming a geometrical structure, the dimension of which is in the order of submicron meter to 1 micrometer, on the front surface of the base film of the film 107, it is possible to transfer such a surface texture that offers a holographic appearance (colors) onto the surface of the surface treatment recipient S. The surface treatment apparatus 100 in this embodiment is structured so that it can treat a specific area or areas of the surface of the surface treatment recipient S. Therefore, it is possible to give a specific area or areas of the surface of the surface treatment recipient S their own texture (and/or pattern) and/or holographic appearance (colors), by using the surface treatment apparatus 100 in combination with multiple films 107 which are different in surface texture (and/or pattern).

The film 107 in this embodiment was roughly 320-350 mm in width in terms of the direction roughly perpendicular to the film conveyance direction. Further, the thermal head 102 in this embodiment is also similar in dimension to the film 107 in terms of the direction roughly perpendicular to the film conveyance direction. Therefore, various surface treatment recipients S, in terms of size, can be treated by the surface treatment apparatus 100 in this embodiment, as long as the surface treatment recipients S are roughly the same as a sheet of A3 size, or smaller. Further, in this embodiment, the film 107 was flat and smooth across its front surface, and was used for providing the surface of the surface treatment recipient S with a certain amount of gloss.

The film 107 in this embodiment is very thin. Thus, once a give portion of the film 107 is used (heated), this portion (heated portion) of the film 107 wrinkles, becoming thereby unusable.

4-4. Separating Section

Next, the separating section of the surface treatment apparatus 100, that is, the section of the surface treatment apparatus 100, which separates the surface treatment recipient S from the film 107, is described. The separation roller 105 has two roles, that is, the role of cooling the film 107, and the role of separating the surface treatment recipient S from the film 107. It may be a metallic roller made up of stainless steel or the like. Further, it may be provided with a cooling mechanism for preventing the separating section from excessively increasing in temperature. As for the choices of cooling mechanism, it is effective to provide the separating section with an air cooling mechanism, cooling fins, or the like.

In this embodiment, in order to separate the surface treatment recipient S from the film 107, the surface treatment apparatus 100 is provided with the separation roller 105, which separates the surface treatment recipient S from the film 107 with the use of its curvature. However, the choices of separating means do not need to be limited to the separation roller 105. For example, the external shell of the thermal head 102 may be utilized to bend the film 107 to separate the surface treatment recipient S from the film 107.

4-5. Basic Operation of Surface Treatment

The surface treatment recipients S are conveyed one by one from the image forming apparatus 200 to the surface treatment apparatus 100. Each surface treatment recipient S is conveyed to the position of the pair of registration rollers 181 of the registration unit 108, and is pressed against the pair of registration rollers 181 to be corrected in attitude, being thereby temporarily stopped by the rollers 181, which are remaining stationary. Then, the pair of registration 181 begin to be rotated, whereby the surface treatment recipient S begins to be conveyed again. Then, the leading edge of the surface treatment recipient S in terms of the surface treatment recipient conveyance direction is detected by the first sensor 110. In response to the detection of the leading edge of the surface treatment recipient S by the first sensor 110, the timing for driving the thermal head 102 is controlled. In the surface treatment station G, the thermal head 102 having the aforementioned line of heat generating elements (resistors) which can be selectively made to generate heat to heat the selected area or areas of the surface of the surface treatment recipient S according to the treatment area information, opposes the platen roller 101, with the presence of the surface treatment recipient passage between the thermal head 102 and platen roller 101. Thus, as the platen roller 101 is rotated, the film 107, and the surface treatment recipient S under the film 107, are conveyed together through the surface treatment station G, with the film 107 and surface treatment recipient S remaining sandwiched by the thermal head 102 and platen roller 101. The thermal head 102 is structured so that it can selectively activate a part or parts of its heat generating resistors in order to heat the surface of the surface treatment recipient S in a pattern determined by the surface treatment area information, which will be described later. The surface treatment apparatus 100 remelts the toner image on the surface of the surface treatment recipient S while conveying the surface treatment recipient S, and keeping the film 107 and surface treatment recipient S sandwiched between its thermal head 102 and platen roller 101. Then, the film 107 is separated from the surface treatment recipient S, in the separating section which is formed by the separation roller 105. The separating station is on the downstream side of the thermal head 102 in terms of the surface treatment recipient conveyance direction. The surface treatment recipient S will have sufficiently cooled by the time it is separated from the film 107. Therefore, the toner image on the surface of the surface treatment recipient S will have solidified by the time when the film 107 is separated from the surface treatment recipient S. Thus, the surface of the surface treatment recipient S retains the transferred surface texture of the film 107, having thereby a desired amount of gloss.

The take-up shaft 103 takes up the film 107 as the film 107 and surface treatment recipient S are conveyed through the surface treatment station G. Further, it provides the film 107 with tension by an amount necessary to separate the film 107 from the surface treatment recipient S, in the separating section G. Incidentally, the surface treatment apparatus 100 is structured so that when the surface treatment apparatus 100 is not in use, a space can be kept between the thermal head 102 and platen roller 101. More specifically, the surface treatment apparatus 100 is structured so that the thermal head 102 can be pressed against the platen roller 101 with the same timing as that with which the treatment start position of the surface treatment recipient S arrives at the surface treatment station G, and then, can be moved away from the platen roller 101 as soon as the treatment ending position of the surface treatment recipient S moves out of the surface treatment station G. In the case where the surface treatment apparatus 100 is structured as described above, the surface treatment apparatus 100 may also be structured so that the take-up roller 103 begins to be driven as soon as the thermal head 102 is pressed against the platen roller 101, and is stopped as soon as the thermal head 102 is moved away from the platen roller 101.

After being subjected to the surface treatment, the surface treatment recipient S is conveyed further by the pair of conveyance rollers 109. Then, it is discharged into the external delivery tray of the surface treatment apparatus 100 by a pair of discharge rollers, and the like.

Figure 7:
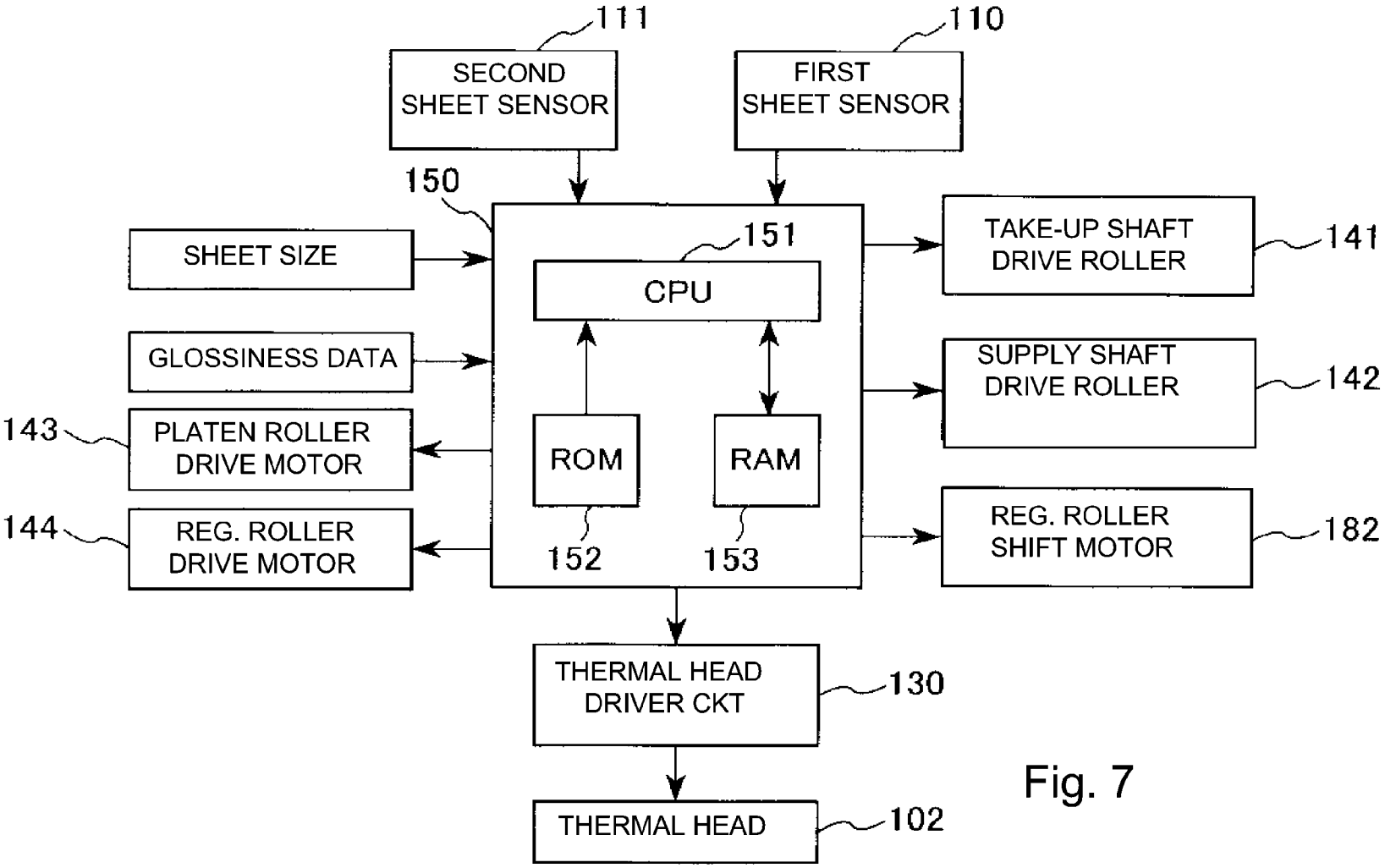
FIG. 7 is a block diagram of the control sequence of the surface treatment apparatus in the first embodiment of the present invention.

FIG. 7 is a block diagram of the surface treatment operation sequence of the surface treatment apparatus 100 in this embodiment. It shows the overall control of the surface treatment operation of the surface treatment apparatus 100. The various operations of the surface treatment apparatus 100 are integrally controlled by a controller 150 (control section) of the apparatus 100. In this embodiment, the controller 150 is enabled to communicate with the unshown controller (control section) of the image forming apparatus 200. The controller 150 controls the operation of each section of the surface treatment apparatus 100, based on the treatment commands inputted from the image forming apparatus 200, and the treatment commands inputted through the control panel (unshown) with which the surface treatment apparatus 100 is provided. In this embodiment, the controller 150 controls the operations of the thermal head driving circuit 130, take-up shaft driving motor 141, supply shaft driving motor 142, platen roller driving motor 143, registration roller driving motor 144, shift motor 183, etc. The controller 150 has: a CPU 151 as controlling means; and a combination of a ROM 152 and a RAM 153 as storage means. It controls the surface treatment apparatus 100 in response to the treatment commands, following the programs and data stored in the ROM 152 and RAM 153. The treatment commands include the treatment area information (gloss data) for making the thermal head 102 to selectively cause its specific heat generating element or elements to generate heat with the same timing as the timing with which the area or areas of the surface of the surface treatment recipient S pass through the surface treatment station G. The thermal head 102 makes active its heat generating resistors which correspond in position to the treatment area or areas of the surface of the surface treatment recipient S, in order to treat the surface of the surface treatment recipient S. Further, the surface treatment apparatus 100 may be structured so that the treatment commands can be inputted into the controller 150 from an external apparatus such as a personal computer.

Generally speaking, a gloss level as high as that of an ordinary photograph means no less than 40%, in particular, no less than 80%, in 60° gloss (JIS Z 8741: mirror surface gloss measurement method). It has been difficult to continuously give multiple sheets of recording medium (surface treatment recipient S) photographic gloss in such a manner that the multiple sheets become different in the area or areas changed in gloss, with the use of a conventional gloss changing means. In comparison, not only can the surface treatment apparatus 100 in this embodiment make the specific area or areas of the surface of the surface treatment recipient S, for example, the top half of the surface of the surface treatment recipient S, as glossy as a photograph, but also, it can make the head line glossy, or specific area or areas of an image glossy, in an optional pattern or patterns, according to the contents of the image.

5. Method for Dealing with Surface Treatment Recipient of Small Size

The surface treatment apparatus 100 in this embodiment is suitable to control in gloss a specific area or areas of a print as described above. It is structured so that it can deal with a wide range of surface treatment recipient S in terms of size, that is, from a surface treatment recipient as small as a postcard or an ordinary envelope to a surface treatment recipient as large as a sheet of paper of A4 size. As the film 107 is used for the surface treatment of the surface treatment recipient S, the portion of the film 107 used for the treatment is made to shrink by the heat applied by the thermal head 102 as described above. Thus, this portion of the film 107 cannot be reused. However, in a case where a surface treatment recipient S of a small size is treated by the surface treatment apparatus 100, a given area of the film 107 in terms of the film conveyance direction is used only across its area which corresponds in position to the surface treatment recipient S in terms of the width direction of the film 107. In other words, a substantial area of the give area of the film 107 in terms of the widthwise direction of the film 107 remain unused, which is inefficient in terms of the utilization of the film 107.

Thus, one of the objects of this embodiment is to enable the surface treatment apparatus 100 structured so that the film 107 can be pressed upon the treatment surface of the surface treatment recipient S while being heated, in order to heat a specific area or areas of the treatment surface of the surface treatment recipient S to control the specific area or areas of the treatment surface in surface texture, and to efficiently use the film 107 to reduce in operational cost the surface treatment apparatus 100.

In order to achieve the above described objective, the surface treatment apparatus 100 in this embodiment generally carries out an operation such as the following one. That is, the surface treatment apparatus 100 is structured so that when it is necessary to continuously treat the surface of each of multiple surface treatment recipients S which are narrower than the film 107 in terms of the widthwise direction of the film 107, the film 107 can be rolled back to reuse the area of the film 107, in terms of the film conveyance direction, which has just been used to treat the immediately preceding surface treatment recipient S: the unused area of the film 107 in terms of the widthwise direction of the film 107, that is, the area of the film 107 in terms of the widthwise direction of the film 107, which was not used to treat the immediately preceding surface treatment recipient S, can be used to treat the surface of the next surface treatment recipient S. Therefore, the surface treatment apparatus 100 in this embodiment is more efficient in the utilization of the film 107, being therefore smaller in operational cost than any of the surface treatment apparatus in accordance with the prior art.

Figure 6:
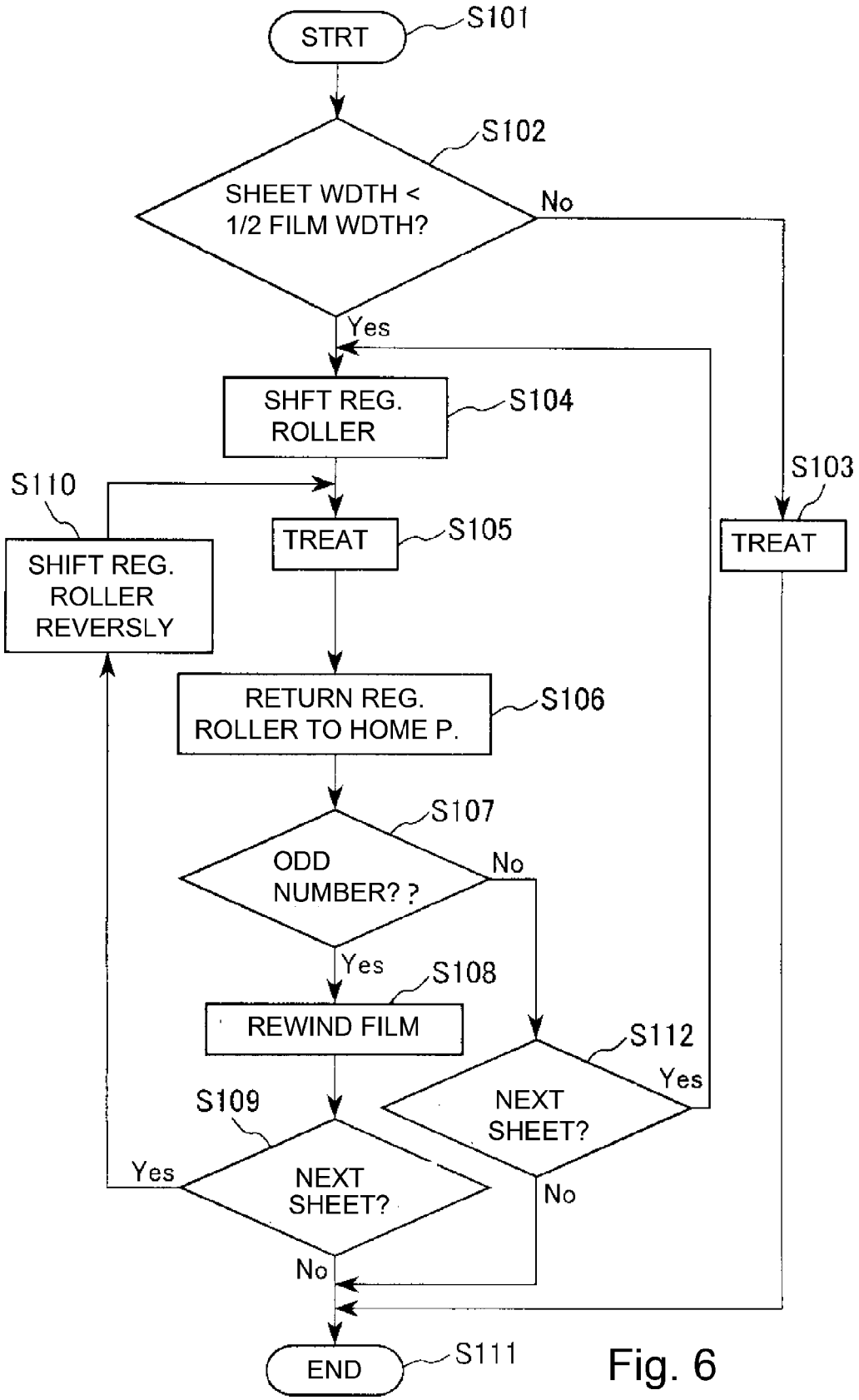
FIG. 6 is a flowchart of an example of the operation of the surface treatment apparatus in the first embodiment of the present invention.

FIG. 6 shows the sequence of the surface treatment operation of the surface treatment apparatus 100 in this embodiment. In the following description of the embodiments of the present invention, the dimension of the surface treatment recipient S in terms of the direction which is roughly perpendicular to the surface treatment recipient conveyance direction (moving direction of surface treatment recipient S), is referred to simply as the "width" of the surface treatment recipient S. Further, the dimension of the film 107 in terms of the direction which is roughly perpendicular to the direction in which the film 107 is moved (moving direction of film 107) is referred to simply as the "width" of the film 107.

As a treatment command is inputted into the controller 150, the controller 150 starts the sequence for treating the surface of the surface treatment recipient S (S101). The surface treatment apparatus 100 in this embodiment is used while the image forming apparatus 200 is in connection to the upstream end of the surface treatment apparatus 100 in terms of the surface treatment recipient conveyance direction. Thus, the sheet T of recording medium outputted from the image forming apparatus 200 after the sheet T was put through an image formation process such as the one described above is conveyed as the surface treatment recipient S to the surface treatment apparatus 100. As the surface treatment recipient S is conveyed to the surface treatment apparatus 100, it is conveyed to the pair of registration rollers 181 for correcting the surface treatment recipient S in attitude. More specifically, the pair of registration rollers 181 is kept on standby, that is, without being rotated. Thus, as the leading edge of the surface treatment recipient S in terms of the surface treatment recipient conveyance direction collides with the pair of registration rollers 181. Thus, the leading edge of the surface treatment recipient S becomes parallel to the pair of registration rollers 181, correcting thereby the surface treatment recipient S in attitude.

Next, the controller 150 determines whether or not the width of the surface treatment recipient S is no more than half the width (preset value) of the film 107 (S102). The information about the size of the surface treatment recipient S is automatically determined by the image forming apparatus 200 and is inputted, as a part of the treatment command, into the controller 150, or it is to be inputted by a user through the control panel (unshown). That is, the controller 150 determines whether or not the width of the surface treatment recipient S is no more than half the width of the film 107, based on the inputted information about the size of the surface treatment recipient S. In this embodiment, the CPU of the controller 150 functions as a means for detecting the width of the surface treatment recipient S, based on the information about the size of the surface treatment recipient S. Also in this embodiment, the CPU 151 of the controller 150 determines whether or not the current operation is for continuously treating multiple small surface treatment recipients S which are the same in size. Incidentally, the CPU 151 of the controller 150 can also detect the width of the surface treatment recipient S, based on the information about the size of the surface treatment recipient S inputted from an external apparatus such as a personal computer.

If the controller 150 determines, in S102, that the width of the surface treatment recipient S is no less than half the width of the film 107, it makes the surface treatment apparatus 100 treat the treatment surface of the surface treatment recipient S, without carrying out the operation (which is described later) for shifting the surface treatment recipient S (S103). In this embodiment, it is also in a case where the multiple small surface treatment recipients S which are the same in size are not continuously treated that the surface treatment recipient S is not shifted. Then, the controller 150 ends the sequence for treating the treatment surface of the surface treatment recipient S (S11).

On the other hand, if the controller 150 determines, in S102, that the width of the surface treatment recipient S is no more than half the width of the film 107, it makes the surface treatment apparatus 100 shift the pair of registration rollers 181 in the direction perpendicular to the surface treatment recipient conveyance direction while making the surface treatment apparatus 100 keep the surface treatment recipient S sandwiched between the pair of registration rollers 181 (S104). In this embodiment, in order to enable the surface treatment apparatus 100 to treat the surface treatment recipient S even if the surface treatment recipient S is slightly greater in size than size A3, film which is in a range of 320 mm-350 mm in width is employed as the film 107. Thus, a sheet of paper which is A5R in size, an ordinary envelop, a postcard, or the like, fall in the category of the surface treatment recipient S, the width of which is no more than half the width of the film 107.

In this embodiment, the surface treatment apparatus 100 is structured so that as the surface treatment recipient S collides with the nip between the pair of registration rollers 181 while the rollers 181 are stationary, the leading edge portion of the surface treatment recipient S in terms of the surface treatment recipient conveyance direction, enters the nip by a short distance, being thereby pinched by the nip. Thus, as the pair of registration rollers 181 are shifted, the surface treatment recipient S also shifts. Incidentally, the surface treatment apparatus 100 may be structured so that before the pair of registration rollers 181 are shifted, they are slightly rotated to ensure that the leading edge portion of the surface treatment recipient S is pinched by the nip. The pair of registration rollers 181 are shifted by a shift motor 182.

Figure 8:
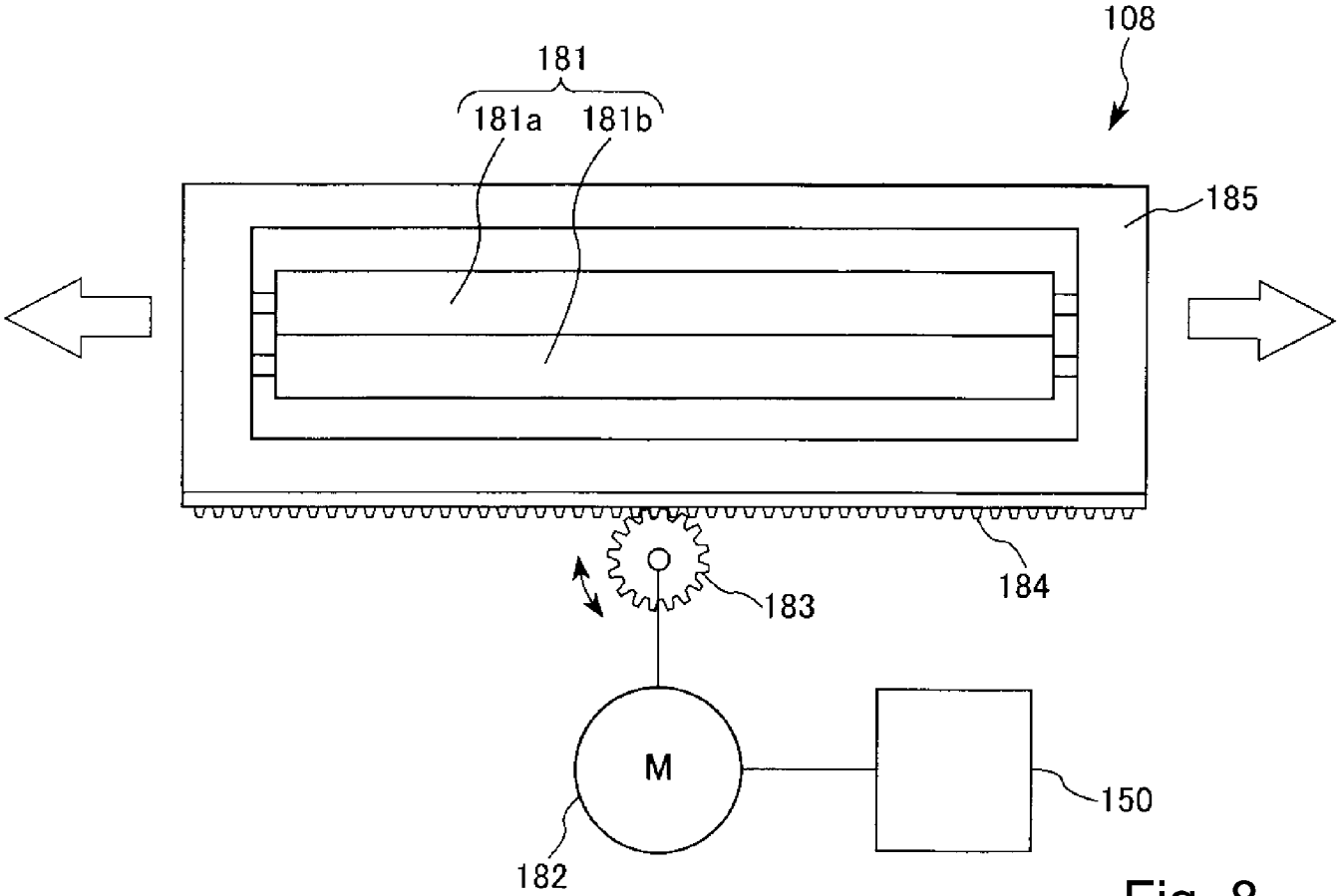
FIG. 8 is a schematic drawing of an example of the surface treatment recipient moving means of the surface treatment apparatus in the first embodiment, and shows the general structure of the means.

The means for shifting the pair of registration rollers 181 in the direction which is roughly perpendicular to the surface treatment recipient conveyance direction may be any means suitable. FIG. 8 is a schematic drawing of an example of the registration roller moving means. It shows the general structure of the registration roller moving means. The registration unit 108 in this embodiment has a frame 185 which internally holds the pair of registration rollers 181 and driving force transmitting means, such as gears, which transmit driving force to the pair of registration rollers 181. The frame 185 is provided with a linear gear 184, as a driving force catching member, which is at the bottom of the frame 185. The linear gear 184 is in mesh with a gear 183, as a driving force transmitting member, with which the main assembly of the surface treatment apparatus 100 is provided. Thus, the frame 185 can be moved in the first direction, which is roughly perpendicular to the surface treatment recipient conveyance direction, or the second direction which is opposite from the first direction, by rotating the registration roller shifting motor 182 in the normal direction, or in reverse, respectively, whereby the pair of registration rollers 181 held by the frame 185 can be moved in the first or second direction, which is roughly perpendicular to the surface treatment recipient conveyance direction. The amount by which the pair of registration rollers 181 is moved by the rotation of the driving gear 183 can be controlled by the controller 150, which controls the amount by which the pair of registration rollers 181 are rotated. In this embodiment, the registration roller unit 108 made up of the pair of registration rollers 181, driving gear 183, linear gear 184, etc., is the means for shifting the pair of registration rollers 181.

Figure 5:
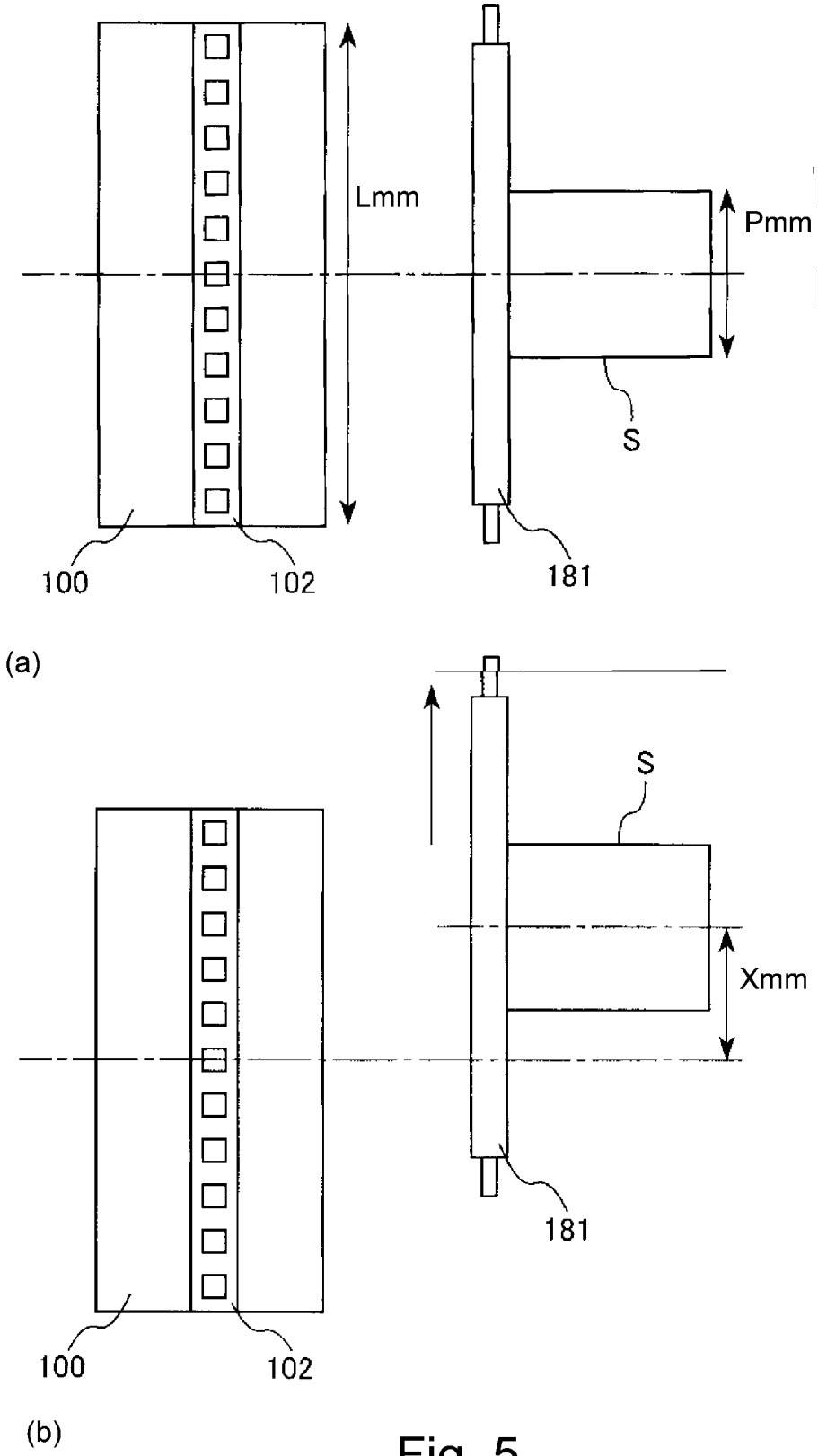
FIG. 5 is a drawing for describing the operation of the surface treatment recipient (print) moving means of the surface treatment apparatus in the first embodiment of the present invention.

The amount by which the pair of registration rollers 181 is shifted is determined based on the size of the surface treatment recipient S. That is, referring to FIGS. 5(*a*) and 5(*b*), it is assumed here that the width of the film 107 is L mm; the width of the surface treatment recipient S is P mm; and the distance by which the surface treatment recipient S is to be shifted by the pair of registration rollers 181 is X mm. Further, the surface treatment apparatus 100 is structured so that while the surface treatment recipient S is conveyed through the surface treatment apparatus 100, the center of the surface treatment recipient S in terms of the widthwise direction of the film 107 remains roughly coincidental to that of the film 107 up to the pair of registration rollers 181. Further, the surface treatment apparatus 100 is structured so that the moment when the leading edge of the surface treatment recipient S in terms of the surface treatment recipient conveyance direction collides with the pair of registration rollers 181, the center of the pair of registration rollers 181 in terms of their lengthwise direction (direction of their rotational axis) roughly coincides with the center of the film 107 in terms of its widthwise direction. Further, value of X (mm) is set within a range which satisfies the following inequality, so that a certain amount of latitude is afforded to prevent the surface treatment recipient S from overlapping with the used portion of the film 107 in terms of the widthwise direction of the film 107.

$$\frac{P}{2} < X < \frac{L-P}{2}$$

Therefore, a given area of the film 107 in terms of the film conveyance direction can be used two or more times for surface treatment.

Next, the controller 150 makes the surface treatment apparatus 100 carry out a surface treatment such as the one described above, after the shifting of the pair of registration rollers 181 (S105). That is, the pair of registration rollers 181 begins to be driven with preset timing, and the surface treatment recipient S is conveyed to the surface treatment station G. Then, the surface treatment recipient S is conveyed through the surface treatment station G along with the film 107, while being pressed upon the film 107 by the combination of the platen roller 101 and thermal head 102, as the film 107 is taken up by the take-up shaft 103 which is being rotationally driven. At the same time, the heat generating resistors of the thermal head 102 are selectively activated in a heating pattern set by the heat treatment area information. During the conveyance of the surface treatment recipient S though the surface treatment station G, the controller 150 controls the thermal head driving circuit 130 so that the heating pattern is shifted in the direction parallel to the direction in which the surface treatment recipient S was shifted, by a distance equal to the distance by which the surface treatment recipient S was shifted. Then, the surface treatment recipient S is separated from the film 107 with the utilization of the curvature of the separation roller 105. Consequently, the treatment surface of the surface treatment recipient S is given a desired amount of gloss.

Further, as the controller 150 determines that the trailing edge of the surface treatment recipient S, in terms of the surface treatment recipient conveyance direction, which is being conveyed through the surface treatment station G, has passed the second sensor, it makes the surface treatment apparatus 100 carry out the following operational sequence. That is, before the leading edge, in terms of the surface treatment recipient conveyance direction, of the next surface treatment recipient S reaches the pair of registration rollers 181, the controller 150 makes the shift motor 182 return the pair of registration rollers 181 to their home position (S106). As the trailing edge of the surface treatment recipient S in terms of the surface treatment recipient conveyance direction is detected by the surface treatment recipient sensor 110, the controller 150 determines that the trailing edge of the surface treatment recipient S has passed through the interface between the pair of registration rollers 181.

Next, the controller 150 determines whether or not the small surface treatment recipient S which is being treated is odd-numbered (S107). If the controller 150 determines that the small surface treatment recipient S is odd-numbered, it stops driving the take-up shaft 103 as soon as the trailing edge, in terms of the surface treatment recipient conveyance direction, of the treated surface treatment recipient S passes by the separating section. Then, it reversely drives the supply shaft 104 to takes back the film 107 (S108). As the trailing edge of the treated surface treatment recipient S in terms of the surface treatment recipient conveyance direction is detected by the second surface treatment recipient Sensor 111, the controller determines that the trailing edge of the treated surface treatment recipient S has passed by the separating section. The length by which the film 107 is to be taken back is the same as the length by which the film 107 is used for treating the last surface treatment recipient S. As described above, in this embodiment, the film 107 is taken back before the second, fourth, sixth surface treatment recipients S, and so on (that is, second surface treatment recipient S in terms of the order in which a surface treatment recipient S is treated by a given area of the film 107 in terms of the film width direction).

Next, the controller 150 determines whether or not there is the next surface treatment recipient S left from the small surface treatment recipients S which are to be continuously treated (S109). If it determines that there is, it makes the surface treatment apparatus 100 convey the next surface treatment recipient S to the pair of registration rollers 181 and collide with the pair of registration rollers 181 to correct the surface treatment recipient S in attitude. As soon as it corrects the surface treatment recipient S in attitude, it makes the pair of registration rollers 181 shift the surface treatment recipient S in the opposite direction from the direction in which the immediately preceding surface treatment recipient S was shifted (S110). Then, the controller 150 makes the surface treatment apparatus 100 carry out an operational sequence similar to the above described one. On the other hand, if the controller 150 determines that there is no surface treatment recipient S left to be treated, it ends the surface treatment sequence (S111).

Further, if the controller 150 determines, in S107, that the surface treatment recipient S to be treated next is even-numbered, it does not make the surface treatment apparatus 100 take back the film 107. Then, it determines whether or not there is a surface treatment recipient S left among the small surface treatment recipients S to be continuously treated (S112). If the controller 150 determines that there is, it goes back to S104. On the other hand, if it determines that there is no surface treatment recipient S left to be treated, it ends the surface treatment sequence (S111).

Each time the controller 150 makes the surface treatment apparatus 100 shift the surface treatment recipient S, it controls the thermal head 102 so that the heating pattern is moved in the same direction as the direction in which the surface treatment recipient S to be treated next was shifted, and by the same distance as the distance by which the surface treatment recipient S was shifted.

Figure 9:
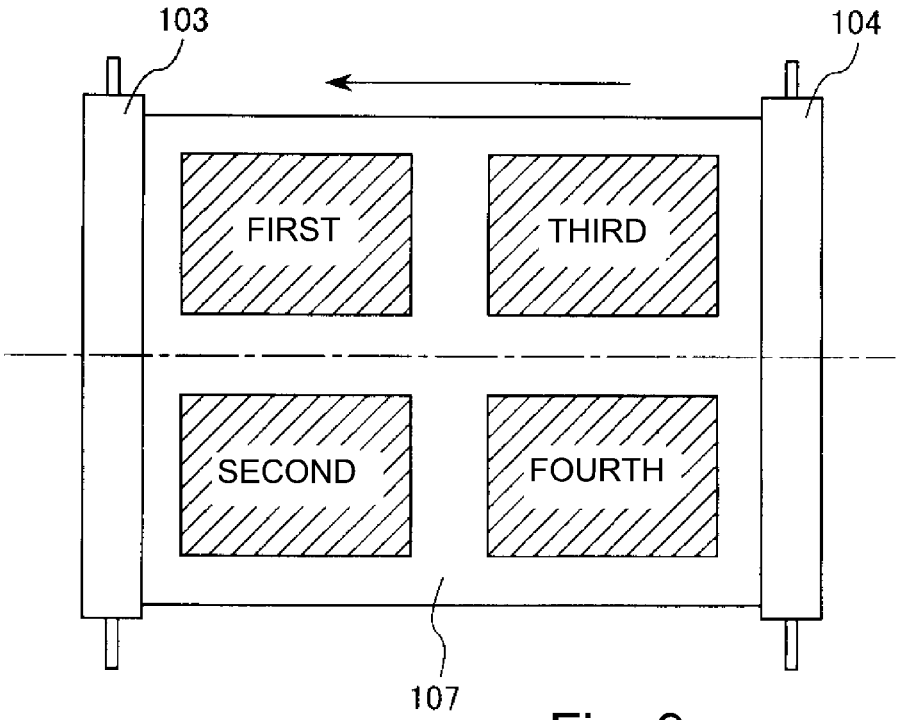
FIG. 9 is a schematic drawing for showing how the surface treatment apparatus in this embodiment uses a given area of its surface treatment film, in terms of the film conveyance direction and widthwise direction of the film.

In a case where the surface treatment apparatus 100 is used to continuously treat multiple small surface treatment recipients S, the controller 150 makes the surface treatment apparatus 100 carry out the above described operational sequence. Thus, the usage of the film 107 becomes as shown in FIG. 9. That is, a given area of the film 107 in terms of the film conveyance direction can be used twice, that is, to give the surface treatment to two consecutive surface treatment recipients S, that is, the odd-numbered one and even-numbered one. In other words, in this embodiment, in a case where multiple small surface treatment recipients S need to be continuously treated, the combination of the shifting of the surface treatment recipient S and taking back of the film 107 is repeated. Thus, this embodiment is efficient in the utilization of the film 107.

As described above, in this embodiment, the surface treatment apparatus 100 has the film 107 which is conveyed in the first direction by being taken up by the take-up shaft while being unrolled from the supply shaft 104. Further, the surface treatment apparatus 100 has the heating means 102 which has multiple heat generating elements. The heat generating elements are aligned in the direction roughly perpendicular to the direction in which the film 107 is conveyed, and can be selectively activated. Thus, the heating means 102 can heat a specific area or areas of the surface of the surface treatment recipient S through the film 107. Further, the surface treatment apparatus 100 heats the treatment surface of the surface treatment recipient S with its heating means 102 while conveying the surface treatment recipient S, in contact with the film 107, in the same direction as the film 107 is conveyed.

Further, the surface treatment apparatus 100 has the combination of the film driving means 141 and 142, which can be driven so that the film 107 is taken up by the take-up shaft 103, and also, so that the film 107 is taken back by the supply shaft 104. The surface treatment apparatus 100 has also the surface treatment recipient moving means which can move the surface treatment recipient S before the surface treatment recipient S is placed in contact with the film 107. The direction in which the surface treatment recipient S is moved by the surface treatment recipient moving means is roughly perpendicular to the direction in which the film 107 is moved. Further, the surface treatment apparatus 100 has the controlling means 151 which makes the surface treatment apparatus 100 carry out the above described surface treatment operation. When it is necessary to continuously treat multiple small surface treatment recipients S, the width of which in terms of the direction perpendicular to the direction in which the film 107 is conveyed is no more than half the width of the film 107, the controlling means 151 makes the surface treatment apparatus 100 carry out the following operation. That is, it makes the film driving means of the surface treatment apparatus 100 take back (roll back) the film 107, and also, makes the surface treatment recipient S moving means of the surface treatment apparatus 100 shift the surface treatment recipient S in the direction roughly perpendicular to the direction in which the film 107 is moved. That is, the controlling means 151 makes the surface treatment apparatus 100 use a given area of the film 107 in terms of the film movement direction twice: half the given area of the film 107 in terms of the widthwise direction of the film 107 is placed in contact with the odd-numbered surface treatment recipient S to treat the surface treatment recipient S, and the other half is placed in contact with the even-numbered surface treatment recipient S to treat the surface treatment recipient S.

In this embodiment, the surface treatment recipient moving means has the pair of registration rollers 181 for correcting the surface treatment recipient S in attitude before the surface treatment recipient S is placed in contact with the film 107. Further, the surface treatment recipient moving means has the registration roller shift motor 182 as the registration roller moving means for moving the registration rollers 181 in the direction roughly perpendicular to the direction in which the film 107 is conveyed. The registration roller shift motor 182 moves the surface treatment recipient S in the direction roughly perpendicular to the film conveyance direction while the surface treatment recipient S remains pinched by the pair of registration rollers 181. Further, the heating means in this embodiment is the thermal head 102 which has multiple heat generating elements aligned in the direction roughly perpendicular to the direction in which the film 107 is conveyed. Further, in this embodiment, the surface treatment apparatus 100 is connected to the image forming apparatus 200 which forms a toner image or toner images on a sheet of recording medium, and fixes the toner image or images to the sheet of recording medium by heating the sheet of recording medium and the toner image or images on the sheet of recording medium. The surface treatment apparatus 100 treats the sheet P of recording medium after the toner image or images are fixed to the sheet P. In this case, the combination of the sheet P of recording medium and the toner image or images on the sheet P is the surface treatment recipient S.

As is evident from the description of this embodiment of the present invention, the present invention can provide a surface treatment apparatus which is structured so that it can give a desired texture to a specific area or areas of the treatment surface of a surface treatment recipient by pressing a film, which can be rolled back and forth between a film supply shaft and a film take-up roller, upon the treatment surface of the surface treatment recipient, and heating the specific area or areas of the surface of the surface treatment recipient through the film, but, is significantly more efficient in film utilization than any surface treatment apparatus in accordance with the prior art. Therefore, it can provide a surface treatment apparatus which is significantly smaller in operational cost than any surface treatment apparatus in accordance with the prior art.

Embodiment 2

Next, another embodiment of the present invention is described. The surface treatment apparatus and image forming apparatus in this embodiment are the same in structure and operation as those in the first embodiment. Therefore, the components, portions, etc., of the image forming apparatus and surface treatment apparatus in this embodiment, which are the same in function and structure, or similar in function and structure to, the counterparts in the first embodiment are given the same referential codes as those given to the counterparts in the first embodiment, and are not going to be described in detail.

The surface treatment apparatus in the first embodiment was an example of a surface treatment apparatus structured so that when it has to continuously treat the multiple small surface treatment recipient S A across their surface, a give area of its film 107 in terms of the film conveyance direction is used to treat a pair of consecutive two surface treatment recipients S; half of the given area of the film 107, in terms of the widthwise direction of the film 109, is used to treat one of the pair of two surface treatment recipients S, and the other half is used to treat the other. However, this first embodiment is not intended to limit the present invention in terms of how many times a given area of the film 107 in terms of the film conveyance direction can be used to treat the surface treatment recipient S. That is, the number of times a given area of the film 107 can be used for the surface treatment depends on the relationship in the size (width) of the surface treatment recipient S and film 107 in terms of the widthwise direction of the film 107.

This embodiment is described with reference to a case in which multiple small surface treatment recipients S, the width of which is no more than one third the width of the film 107, are continuously treated across their surface, more specifically, a case in which multiple postcards (100 mm in width) are continuously treated with the use of the film 107 which is 350 mm in width.

Figure 10:
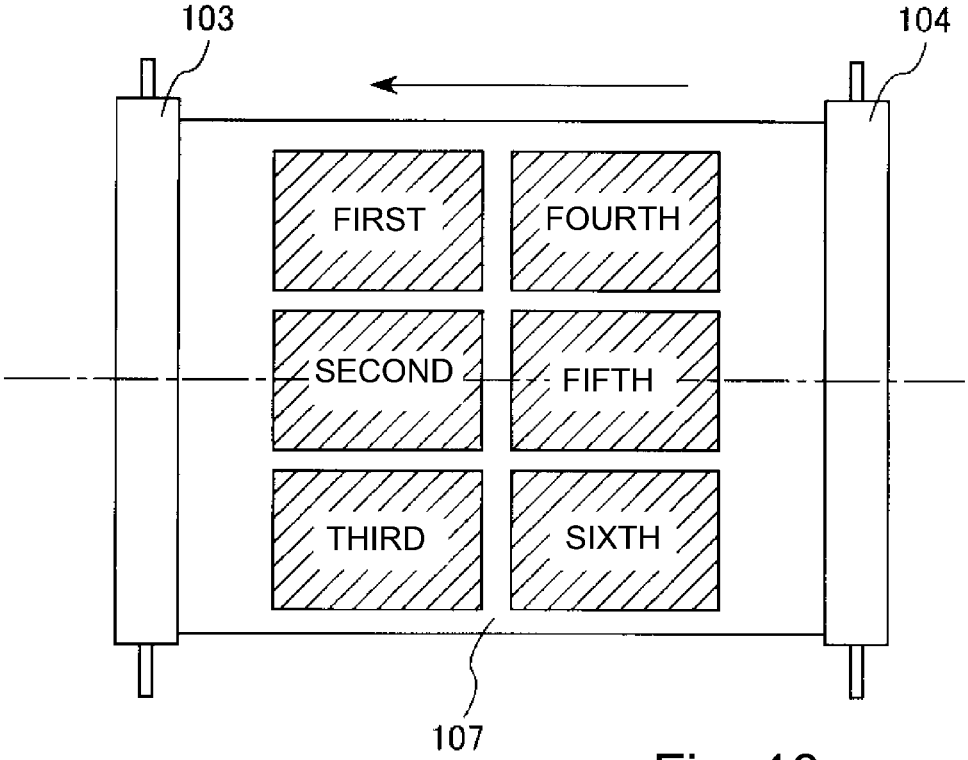
FIG. 10 is a schematic drawing for showing how the surface treatment apparatus in another embodiment of the present invention uses its surface treatment film, in terms of the film conveyance direction and widthwise direction of the film.

In this embodiment, the film 107 is wide enough to treat three surface treatment recipients S (postcards). More specifically, in a case where multiple surface treatment recipients S of this size (postcard size) are continuously treated using the film 107 which is 350 mm in width, a given area of the film 107 in terms of the film conveyance direction is used as shown in FIG. 10. That is, when the second surface treatment recipient S, fifth surface treatment recipient S, and so on, that is, (2+3(n−1))th (n is natural number), are treated, they are not shifted, and therefore, the center portion of the film 107 in terms of the widthwise direction of the film 107 is used. However, when the other surface treatment recipients S are treated, they are shifted with the use of the pair of registration rollers 181 before they are treated across their surface. More specifically, in this embodiment, the film 107 is taken back (rolled back) before the second surface treatment recipient S, third surface treatment recipient S, fifth surface treatment recipient S, sixth surface treatment recipient S, and so on (that is, surface treatment recipients S which are second, third, in terms of the order in which surface treatment recipient S is treated by given area of film 107 in terms of film width direction). In this embodiment, the amount X mm by which the surface treatment recipient S is to be shifted is in a range which satisfies the following inequality so that a certain amount of latitude is afforded to prevent the used portion of the film 107 in terms of the widthwise direction of the film 107 from overlapping with the area or areas of the surface of the surface treatment recipient S which are to be treated.

$$P < X < \frac{L-P}{2}$$

That is, the film 107 can be more efficiently used by repeating the combination of the shifting of the surface treatment recipient S and taking back (rolling back) the film 107 as described above.

Embodiment 3

Next, another embodiment of the present invention is described. In the following description of this embodiment, the components, portions, etc., of the image forming apparatus and surface treatment apparatus in this embodiment, which are the same in function and structure as, or similar in function and structure to, the counterparts in the first embodiment, are given the same referential codes as those given to the counterparts, one for one, and are not going to be described in detail.

The first and second embodiments of the present invention were described with reference to a case in which the surface treatment apparatus 100 is connected to the image forming apparatus 200, and the sheet T of recording medium is conveyed, as the surface treatment recipient S, to the surface treatment apparatus 100 after an image or images are formed on the sheet T by the image forming apparatus 200. However, they are not intended to limit the present invention in scope. For example, the present invention is also applicable to a surface treatment apparatus 100 which treats the surface of the sheet T of recording medium, on which an image or images were formed by an image forming apparatus (200), which is not in connection to the surface treatment apparatus 100 and uses thermally meltable toner.

Figure 11:
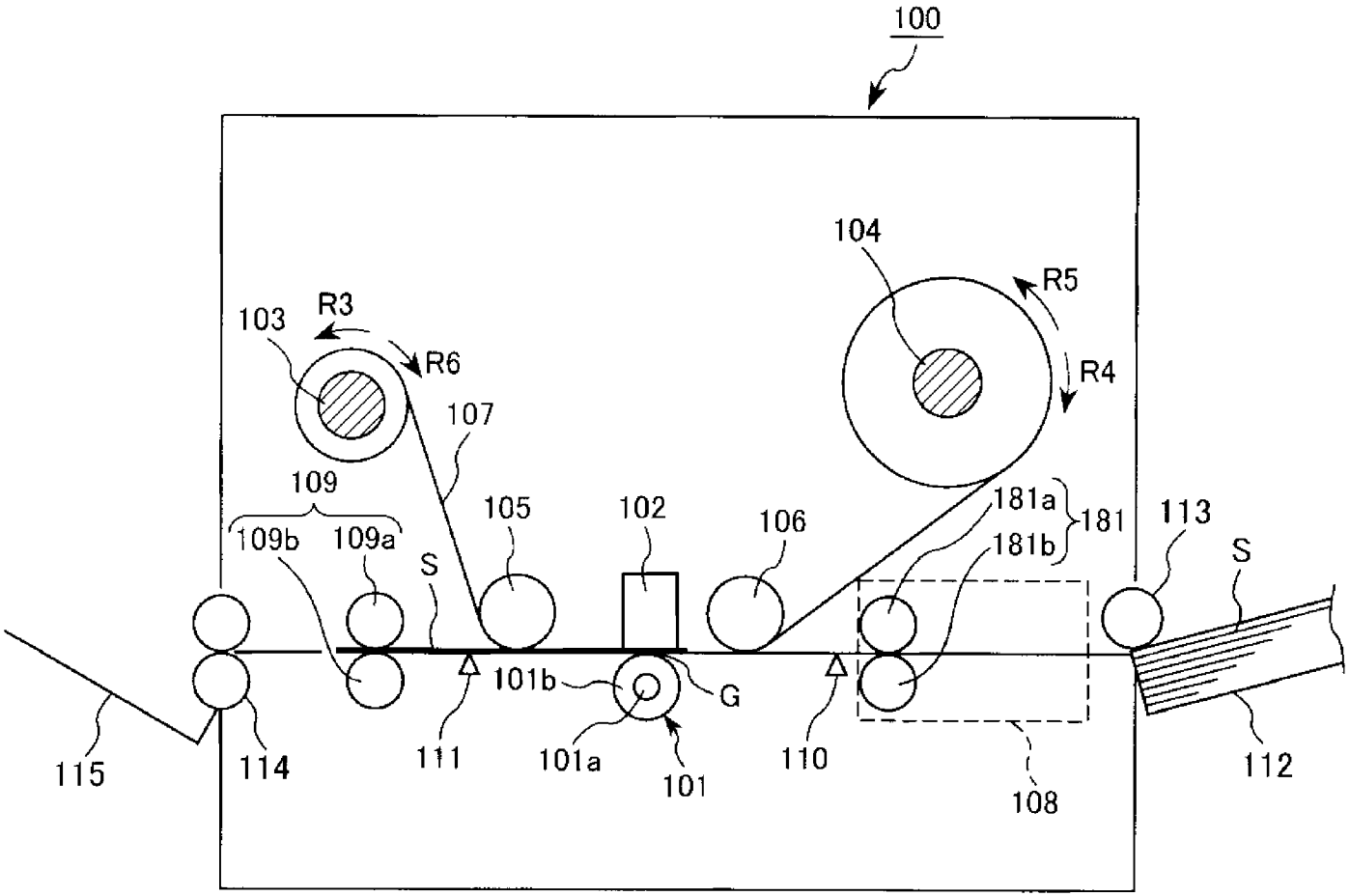
FIG. 11 is a schematic sectional view of the surface treatment apparatus in another embodiment of the present invention, and shows the general structure of the apparatus.

FIG. 11 is a schematic sectional view of the surface treatment apparatus 100 in this embodiment. The surface treatment apparatus 100 is not in connection to an image forming apparatus (100). That is, it is independent from an image forming apparatus. It is provided with a cassette 112 in which a sheet T, or sheets T, of recording medium on which an image or images were formed by an image forming apparatus which is not in connection to the surface treatment apparatus 100 are stored. It is also provided with a feed roller 113 or the like which feeds one by one the sheets T of recording medium (surface treatment recipients S) into the main assembly of the surface treatment apparatus 100 from the cassette 112. As the surface treatment recipient S (print) is fed into the main assembly of the surface treatment apparatus 100, it is conveyed to the pair of registration rollers 181 of the registration unit 108. Further, the surface treatment apparatus 100 in this embodiment is provided with a pair of discharge rollers 114 and a delivery tray 115. The discharge rollers 114 are for discharging the surface treatment recipient S from the surface treatment apparatus 100 after the treatment surface of the surface treatment recipient S is treated. The delivery tray 115 is where the surface treatment recipients S are to accumulate as they are discharged from the surface treatment apparatus 100. The information about the size of the surface treatment apparatus S is to be inputted by a user with the use of the control panel (unshown) of the surface treatment apparatus 100, although it may be inputted through an external apparatus such as a personal computer.

The present invention is also applicable to a surface treatment apparatus such as the one in this embodiment described above. The effects of the application are similar to those stated in the description of the first and second embodiments.

[Miscellanies]

The foregoing is the description of the present invention with reference to the preferred embodiments of the present invention. However, these embodiments of the present invention are not intended to limit the present invention in scope.

In the preceding embodiments of the present invention, the recipients of the surface treatment were full-color prints, that is, the combinations of a sheet f recording medium and the full-color image made up of yellow, magenta, cyan, and black toners, on the sheet of recording medium, by an electrophotographic image forming apparatus. However, these embodiments are not intended to limit the present invention in terms of the number of color toners used to form a full-color toner image.

For example, the present invention is compatible with a surface treatment apparatus capable of treating the surface of a print (recipient of surface treatment), that is, a combination of a sheet of recording medium and a multicolor image formed thereon of the abovementioned four color toners and a transparent toner, that is, toner which does not contain a coloring agent. In such a case, the image forming apparatus (200) is provided with an image forming station for forming a transparent image. The image formation station for forming a transparent image is the same in structure as the image forming stations 210Y, 210M, 210C and 210Bk of the image forming apparatus 200 in FIG. 1, and is placed most upstream, in terms of the moving direction of the image bearing surface of the intermediary transfer belt 207. As the transparent toner, it is possible to use particles of pigment free resin, for example, particles made primarily of polyester resin. Further, the transparent toner is desired to be resin particles, which are high in transparency, virtually free of coloring agent, virtually colorless, and capable of transmitting at least visible spectrum of light without dispersing it. However, the transparent toner may be such that it becomes virtually colorless and transparent as it is subjected to the fixing process. That is, it does not need to be transparent before fixation. For example, it may appear white before fixation. Further, the transparent toner image may be outputted in such a pattern that the area or areas of the image formation surface of a sheet of recording medium, which are relatively low in print ratio, are covered with the transparent toner in order for the entirety of the image formation surface of the sheet of recording medium to be covered with the toners. With the entirety of the image formation surface of the sheet of recording medium covered with the toners, any area or areas of the print (surface treatment recipient S) can be treated. Further, the image forming apparatus 200 may be structured so that the entirety of the image formation area of a sheet of recording medium is covered with a preset amount of transparent toner.

Further, not only is the present invention applicable to a surface treatment apparatus capable of treating a print made by the above described image formation processes which uses four or five toners, different in color (inclusive of transparency), but also, a print formed by forming an image on a sheet of resin-coated recording medium, with the use of the above described image formation process which uses four toners different in color.

For example, the present invention is also applicable to a surface treatment apparatus capable of treating a print created by thermal transfer recording, sublimation transfer recording, inkjet recording, etc., and the effects of the application are similar to those described. Also in this case, the entirety of the image bearing surface of a print (surface treatment recipient) may be covered with a layer of thermoplastic resin so that any area or areas of the image bearing surface of the print (surface treatment recipient) can be treated.

As for the order in which multiple areas of the film 107 in terms of the widthwise direction of the film 107 are used, it does not need to be limited to those described above. For example, it may be set according to the number of small surface treatment recipients to be continuously treated, in order to minimize the number of times the film 107 has to be taken back (rolled back).

The preceding embodiments of the present invention were described with reference to an apparatus for making glossy a specific area or areas of the surface of a print (recipient of surface treatment). In the field of printing, however, it is required to output a print, a specific area or areas of which have metallic appearance, that is, appear golden or silvery. A thermal transfer printer which uses a thermal head can form a metallic image. More specifically, a thin layer of metal is formed, as ink of metallic color, on a sheet of film by vapor deposition, and a metallic image is formed by transferring the thin layer of metal onto a sheet of recording medium. The film used for thermal transfer is made up of a substrate layer (substrate film) and an ink layer coated on the substrate layer. In some cases, the ink layer is coated on the substrate layer with the presence of a parting layer between the ink layer and substrate layer. In other cases, an adhesive layer is formed on the ink layer. The present invention is also applicable to an apparatus which uses a thermal head, and a sheet of film having a layer of metallic color (for example, layer of vapor deposited metal of gold or silver color), and thermally transferring an image of metallic color onto a specific area or areas of a print (surface treatment recipient) by heating the sheet of film with its thermal head. The present invention can also make this type of apparatus more efficiently use the film when the apparatus is used for continuously treating multiple small prints (surface treatment recipients), being therefore capable of reducing the apparatus in operational cost. As far as the present invention is concerned, the "surface treatment" of a print (surface treatment recipient) includes thermally transferring ink of metallic color onto an area or areas of the image bearing surface of a print (surface treatment recipient) to form an image or images of a specific color on the areas of the image bearing surface of the print in order to give the areas metallic gloss and/or make the areas appear metallic.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 037717/2011 filed Feb. 23, 2011 which is hereby incorporated by reference.

What is claimed is:

1. A glossing apparatus for glossing at least part of a toner image on a recording material, comprising:

a film;

a supply roller on which said film is wound;

a wind-up roller configured to wind-up said film;

a driving device configured to drive said wind-up roller to rotate;

a heating device configured to heat at least part of the toner image on the recording material through said film at a heating position between said supply roller and said wind-up roller in a glossing operation;

a reversing device configured to reverse said film toward said supply roller to use an unused area of said film which has not been in contact with the recording material and which has been passed through the heating position during the glossing operation;

a conveying device configured to (i) convey the recording material toward the heating position, and (ii) shift the recording material so that an area in which the recording material is in contact with said film is within the unused area of said film in a widthwise direction of said film; and a controller configured to control a reversing operation of said reversing device and a shifting operation of said conveying device based on a width of the recording material in the widthwise direction, and when the width of the recording material is not less than a predetermined amount of the film width, the reversing operation and the shifting operation are not performed.

2. The glossing apparatus according to claim 1, wherein when glossing operations for preceding and subsequent recording materials, each having a width which is smaller than a maximum width of the recording material usable in said apparatus in the widthwise direction, are continuously performed, said conveying device conveys the preceding and subsequent recording materials so that a first area of which said film is in contact with the preceding recording material and a second area of which said film is in contact with the subsequent recording material are substantially aligned with each other in the widthwise direction, and said conveying device reverses said film so that the first area and the second area are substantially side-by-side with each other in a moving direction of said film upon a wind-up of said film.

3. The glossing apparatus according to claim 2, wherein said conveying device reverses said film after the preceding recording material is heated at the heating position, and then said driving device drives said wind-up roller so that the subsequent recording material is heated at the heating position.

4. The glossing apparatus according to claim 1, wherein said conveying device includes a pair of rollers configured to convey the recording material toward the heating position, said pair of rollers is shiftable while nipping the recording material in the widthwise direction.

5. The glossing apparatus according to claim 1, wherein said heating device includes a plurality of heat generating elements arranged along the widthwise direction.

6. The glossing apparatus according to claim 1, further comprising a separating roller disposed at a downstream position from the heating position in a conveying direction of the recording material and configured to separate the recording material from said film.

7. A glossing apparatus for glossing at least part of a toner image on a recording material comprising:

a film;

a supply roller on which said film is wound;

a winding-up roller configured to wind-up said film;

a driving device configured to drive said winding-up roller to rotate;

a heating device configured to heat at least part of the toner image on the recording material through said film at a heating position between said supply roller and said winding-up roller in a glossing operation;

a shifting device configured to shift a position of the recording material to be conveyed toward the heating position in a widthwise direction of said film;

a reversing device configured to reverse said film toward said supply roller to use an unused area of said film which has not been in contact with the recording material and which has been passed through the heating position during the glossing operation; and a controller configured to control a shifting operation of said shifting device and a reversing operation of said reversing device based on a width of the recording material in the widthwise direction, and when the width of the recording material is not less than a predetermined amount of the film width, the reversing operation and the shifting operation are not performed, wherein when glossing operations for preceding and subsequent recording materials each having a width which is smaller than a maximum width of the recording material usable in said apparatus in the widthwise direction are continuously performed, (i) said shifting device shifts the preceding recording material in one direction of the widthwise direction, (ii) said reversing device reverses said film after the preceding recording material is heated, and (iii) said shifting device shifts the subsequent recording material in the other direction of the widthwise direction so that an area in which the subsequent recording material is in contact with said film is within the unused area of said film, due to control by said controller.

8. The glossing apparatus according to claim 7, wherein said controller controls said shifting device and said reversing device so that a first area of which said film is in contact with the preceding recording material and a second area of which said film is in contact with the subsequent recording material are substantially aligned with each other in the widthwise direction, and the first area and the second area are substantially side-by-side with each other in a moving direction of said film upon a wind-up of said film.

9. The glossing apparatus according to claim 7, wherein said shifting device includes a pair of rollers configured to convey the recording material toward the heating position, said pair of rollers is shiftable while nipping the recording material in the widthwise direction.

10. The glossing apparatus according to claim 7, wherein said heating device includes a plurality of heat generating elements arranged along the widthwise direction.

11. The glossing apparatus according to claim 7, further comprising a separating roller disposed at a downstream position from the heating position in a conveying direction of the recording material and configured to separate the recording material from said film.

* * * * *